US011699399B2

(12) United States Patent
Kim et al.

(10) Patent No.: US 11,699,399 B2
(45) **Date of Patent: *Jul. 11, 2023**

(54) SCAN DRIVER

(71) Applicant: Samsung Display Co., Ltd., Yongin-si (KR)

(72) Inventors: Jong Hee Kim, Yongin-si (KR); Tak Young Lee, Yongin-si (KR); Bo Yong Chung, Yongin-si (KR); Yang Hwa Choi, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/577,301

(22) Filed: Jan. 17, 2022

(65) Prior Publication Data

US 2022/0139327 A1 May 5, 2022

Related U.S. Application Data

(63) Continuation of application No. 16/903,307, filed on Jun. 16, 2020, now Pat. No. 11,227,552.

(30) Foreign Application Priority Data

Sep. 11, 2019 (KR) ..... 10-2019-0112761

(51) Int. Cl.
*G09G 3/3266* (2016.01)
*G09G 3/3258* (2016.01)

(52) U.S. Cl.
CPC ..... *G09G 3/3266* (2013.01); *G09G 3/3258* (2013.01); *G09G 2310/0202* (2013.01)

(58) Field of Classification Search
CPC combination set(s) only.
See application file for complete search history.

(56) References Cited

U.S. PATENT DOCUMENTS 9,071,230 B2 6/2015 Kim et al.
9,685,948 B2 6/2017 Kim et al.
(Continued)

FOREIGN PATENT DOCUMENTS

KR 10-2017-0078978 7/2017
KR 10-2018-0007719 1/2018
(Continued)

OTHER PUBLICATIONS

Hong-Jae Shin, A Novel OLED Display Panel with High-Reliability Integrated Gate Driver Circuit using IGZO TFTs for Large-Sized UHD TVs, Journal, pp. 358-360, 28-2, OLED TV Development Group, LG Display Co., Paju-si, Republic of Korea.
(Continued)

*Primary Examiner* — Van N Chow
(74) *Attorney, Agent, or Firm* — H.C. Park & Associates, PLC

(57) ABSTRACT

A scan driver including a plurality of scan stages. A first scan stage among the plurality of scan stages includes first-to-sixth transistors and a first capacitor. The first transistor is connected to a first Q node, a first scan clock line, and a first scan line. A second transistor is connected to a first scan carry line and the first Q node. A third transistor is connected to a first sensing carry line and a second sensing carry line. A fourth transistor is connected to a first control line and the third transistor. A fifth transistor is connected to the fourth transistor, a second control line, and a first node. A first capacitor is connected to the fifth transistor. A sixth transistor is connected to a third control line, the first node, and the first Q node.

10 Claims, 15 Drawing Sheets

(56) References Cited

U.S. PATENT DOCUMENTS

| | | | | |
|---|---|---|---|---|
| 9,830,845 | B2 | 11/2017 | Lim et al. | |
| 9,875,710 | B2 | 1/2018 | Kim et al. | |
| 10,706,784 | B2 | 7/2020 | Kim et al. | |
| 10,997,910 | B2 | 5/2021 | Hwang et al. | |
| 2016/0217728 | A1 | 7/2016 | In et al. | |
| 2016/0293094 | A1 | 10/2016 | Park et al. | |
| 2017/0186394 | A1 | 6/2017 | Park et al. | |
| 2018/0018921 | A1 | 1/2018 | Park et al. | |
| 2018/0337682 | A1 | 11/2018 | Takasugi et al. | |
| 2020/0066211 | A1 | 2/2020 | Lee et al. | |
| 2020/0184898 | A1 | 6/2020 | Choi | |
| 2020/0193912 | A1 | 6/2020 | Park et al. | |
| 2020/0219451 | A1 | 7/2020 | Kim | |
| 2020/0243018 | A1 | 7/2020 | Kim et al. | |
| 2020/0372851 | A1 | 11/2020 | Kim et al. | |
| 2021/0065617 | A1* | 3/2021 | Choi | G09G 3/32 |
| 2021/0158760 | A1* | 5/2021 | Jang | G09G 3/3266 |
| 2021/0366402 | A1* | 11/2021 | In | G09G 3/296 |

FOREIGN PATENT DOCUMENTS

| | | |
|---|---|---|
| KR | 10-2018-0066375 | 6/2018 |
| KR | 10-2018-0128123 | 12/2018 |
| KR | 10-2019-0009019 | 1/2019 |
| KR | 10-2020-0085976 | 7/2020 |
| KR | 10-2020-0094895 | 8/2020 |
| KR | 10-2020-0135633 | 12/2020 |
| KR | 10-2021-0027576 | 3/2021 |

OTHER PUBLICATIONS

Kyung Min Kim, Bezel Free Design of Organic Light Emitting Diodes via a—InGaZnO Gate Driver Circuit Integration within Active Array, Journal, pp. 1-5, LG Display R&D Center, Seoul, Republic of Korea.

Restriction Requirement dated Jan. 29, 2021, issued to U.S. Appl. No. 16/744,009.

Non-Final Office Action dated Apr. 8, 2021, issued to U.S. Appl. No. 16/744,009.

Notice of Allowance dated Jul. 22, 2021, issued in U.S. Appl. No. 16/744,009.

Non-Final Office Action dated Jul. 9, 2021, issued to U.S. Appl. No. 16/941,140.

Notice of Allowance dated Nov. 18, 2021, issued to U.S. Appl. No. 16/744,009.

Non-Final Office Action dated May 19, 2021, issued to U.S. Appl. No. 16/903,307.

Notice of Allowance dated Sep. 15, 2021, issued to U.S. Appl. No. 16/903,307.

Non-Final Office Action dated Sep. 20, 2022 in U.S. Appl. No. 17/699,943.

Notice of Allowance dated Feb. 2, 2023 in U.S, U.S. Appl. No. 17/699,943.

Final Office Action dated Mar. 2, 2023 in U.S. Appl. No. 17/827,272.

* cited by examiner

<SENSING PERIOD>

SCAN DRIVER

CROSS REFERENCE TO RELATED APPLICATIONS

This application is a continuation of U.S. patent application Ser. No. 16/903,307, filed on Jun. 16, 2020, which claims priority from and the benefit of Korean Patent Application No. 10-2019-0112761, filed on Sep. 11, 2019, which is hereby incorporated by reference for all purposes as if fully set forth herein.

BACKGROUND

Field

Exemplary embodiments of the invention relate generally to a scan driver.

Discussion of the Background

Each pixel of a display device may emit light at a luminance corresponding to a data signal input through a data line. The display device may display a frame image with a combination of light emitting pixels.

A plurality of pixels may be connected to each data line. Therefore, a scan driver that provides a scan signal for selecting a pixel to which a data signal is to be supplied is required. The scan driver may be configured in a form of a shift register to sequentially provide a scan signal of a turn-on level in a scan line unit.

As occasion demands, for example, in order to obtain mobility information or threshold voltage information of a driving transistor of the pixel, a scan driver capable of selectively providing a scan signal of a turn-on level to only to a desired scan line is required.

When one scan line is selected for each frame to provide a scan signal to the selected scan line, in order to provide the scan signal to all scan lines, that is, in order to obtain characteristic information of all pixels in a display device (that is, in order to obtain mobility information or threshold voltage information of a driving transistor), a relatively long time may be taken.

The above information disclosed in this Background section is only for understanding of the background of the inventive concepts, and, therefore, it may contain information that does not constitute prior art.

SUMMARY

Exemplary embodiments of the present invention provide a scan driver capable of selecting plurality of scan lines in one frame and sequentially providing a scan signal to the selected scan lines.

Additional features of the inventive concepts will be set forth in the description which follows, and in part will be apparent from the description, or may be learned by practice of the inventive concepts.

A scan driver according to an exemplary embodiment of the invention includes a plurality of scan stages. A first scan stage among the plurality of scan stages includes a first transistor having a gate electrode connected to a first Q node one electrode connected to a first scan clock line, and another electrode connected to a first scan line; a second transistor having a gate electrode and one electrode connected to a first scan carry line, and another electrode connected to the first Q node; a third transistor having a gate electrode connected to a first sensing carry line and one electrode connected to a second sensing carry line; a fourth transistor having a gate electrode connected to a first control line, and one electrode connected to another electrode of the third transistor; a fifth transistor having a gate electrode connected to another electrode of the fourth transistor, one electrode connected to a second control line, and another electrode connected to a first node; a first capacitor having one electrode connected to the one electrode of the fifth transistor, and another electrode connected to the gate electrode of the fifth transistor; and a sixth transistor having a gate electrode connected to a third control line, one electrode connected to the first node, and another electrode connected to the first Q node.

The first scan stage may further include a seventh transistor having a gate electrode connected to the first Q node, one electrode connected to the second control line, and another electrode connected to the first node.

A first control signal provided through the first control line may include a plurality of pulses during one frame, and a second sensing carry signal may be written to the first capacitor while both of a pulse of a first sensing carry signal provided through the first sensing carry line and a pulse of the second sensing carry signal provided through the second sensing carry line overlap one of the pulses of the first control signal.

The first scan stage may further include a second capacitor having one electrode connected to the gate electrode of the first transistor and another electrode connected to the other electrode of the first transistor; an eighth transistor having a gate electrode connected to the first Q node, one electrode connected to a first sensing clock line, and another electrode connected to a first sensing line; a third capacitor having one electrode connected to the gate electrode of the eighth transistor and another electrode connected to another electrode of the eighth transistor; and a ninth transistor having a gate electrode connected to the first Q node, one electrode connected to a first carry clock line, and another electrode connected to a first carry line.

The first scan stage may further include a tenth transistor having a gate electrode connected to a first reset carry line, one electrode connected to the first Q node, and another electrode connected to a first power line.

The first scan stage may further include an eleventh transistor having a gate electrode connected to a first QB node, one electrode connected to the first Q node, and another electrode connected to the first power line; and a twelfth transistor having a gate electrode connected to a second QB node, one electrode connected to the first Q node, and another electrode connected to the first power line.

The first scan stage may further include a thirteenth transistor having a gate electrode connected to the first QB node, one electrode connected to the first carry line, and another electrode connected to the first power line; a fourteenth transistor having a gate electrode connected to the second QB node, one electrode connected to the first carry line, and another electrode connected to the first power line; a fifteenth transistor having a gate electrode connected to the first QB node, one electrode connected to the first sensing line, and another electrode connected to a second power line; a sixteenth transistor having a gate electrode connected to the second QB node, one electrode connected to the first sensing line, and another electrode connected to the second power line; a seventeenth transistor having a gate electrode connected to the first QB node, one electrode connected to the first scan line, and another electrode connected to the second power line; and an eighteenth transistor having a gate electrode connected to the second QB node, one electrode connected to the first scan line, and another electrode connected to the second power line.

The first scan stage may further include a nineteenth transistor having a gate electrode connected to a fourth control line, one electrode connected to the gate electrode of the fifth transistor, and another electrode connected to the first power line.

The first scan stage may further include a twentieth transistor having a gate electrode connected to the fourth control line, one electrode connected to the first Q node, and another electrode connected to the first power line; a twenty-first transistor having a gate electrode connected to the first Q node, one electrode connected to the first power line, and another electrode connected to the first QB node; and a twenty-second transistor having a gate electrode connected to the first scan carry line, one electrode connected to the first power line, and another electrode connected to the first QB node.

The first scan stage may further include a twenty-third transistor having a gate electrode connected to the other electrode of the fourth transistor, and one electrode connected to the first power line; and a twenty-fourth transistor having a gate electrode connected to the third control line, one electrode connected to another electrode of the twenty-third transistor, and another electrode connected to the first QB node.

The first scan stage may further include a twenty-fifth transistor having a gate electrode and one electrode connected to a fifth control line; and a twenty-sixth transistor having a gate electrode connected to another electrode of the twenty-fifth transistor, one electrode connected to the fifth control line, and another electrode connected to the first QB node.

The first scan stage may further include a twenty-seventh transistor having a gate electrode connected to the first Q node, one electrode connected to the gate electrode of the twenty-sixth transistor, and another electrode connected to a third power line; and a twenty-eighth transistor having a gate electrode connected to a second Q node, one electrode connected to the gate electrode of the twenty-sixth transistor, and another electrode connected to the third power line.

The nineteenth transistor may further include a first sub-transistor having a gate electrode connected to the fourth control line, and one electrode connected to the other electrode of the fourth transistor; and a second sub-transistor having a gate electrode connected to the fourth control line, one electrode connected to another electrode of the first sub-transistor, and another electrode connected to the first power line. The first scan stage may further include a twenty-ninth transistor having a gate electrode connected to the other electrode of the fourth transistor, one electrode connected to the one electrode of the fourth transistor, and another electrode connected to the second control line.

A second scan stage among the plurality of scan stages may include a thirtieth transistor having a gate electrode connected to the second Q node, one electrode connected to a second scan line, and another electrode connected to a second scan clock line; a fourth capacitor connecting the gate electrode and the one electrode of the thirtieth transistor to each other; a thirty-first transistor having a gate electrode connected to the second Q node, one electrode connected to a second sensing line, and another electrode connected to a second sensing clock line; a fifth capacitor connecting the gate electrode and the one electrode of the thirty-first transistor to each other; and a thirty-second transistor having a gate electrode connected to the second Q node, one electrode connected to a second carry line, and another electrode connected to a second carry clock line.

The second scan stage may further include a thirty-third transistor having a gate electrode connected to the first QB node, one electrode connected to the first power line, and another electrode connected to the second Q node; and a thirty-fourth transistor having a gate electrode connected to the second QB node, one electrode connected to the first power line, and another electrode connected to the second Q node.

The second scan stage may further include a thirty-fifth transistor having a gate electrode, one electrode, and another electrode, the gate electrode and the other electrode being connected to a sixth control line; a thirty-sixth transistor having a gate electrode connected to the one electrode of the thirty-fifth transistor, one electrode connected to the second QB node, and another electrode connected to the sixth control line; a thirty-seventh transistor having a gate electrode connected to the first Q node, one electrode connected to the third power line, and another electrode connected to the gate electrode of the thirty-sixth transistor; and a thirty-eighth transistor having a gate electrode connected to the second Q node, one electrode connected to the third power line, and another electrode connected to the gate electrode of the thirty-sixth transistor.

The second scan stage may further include a thirty-ninth transistor having a gate electrode connected to the first QB node, one electrode connected to the first power line, and another electrode connected to the second carry line; a fortieth transistor having a gate electrode connected to the second QB node, one electrode connected to the first power line, and another electrode connected to the second carry line; a forty-first transistor having a gate electrode connected to the first QB node, one electrode connected to the second power line, and another electrode connected to the second sensing line; a forty-second transistor having a gate electrode connected to the second QB node, one electrode connected to the second power line, and another electrode connected to the second sensing line; a forty-third transistor having a gate electrode connected to the first QB node, one electrode connected to the second power line, and another electrode connected to the second scan line; and a forty-forth transistor having a gate electrode connected to the second QB node, one electrode connected to the second power line, and another electrode connected to the second scan line.

The second scan stage may further include a forty-fifth transistor having a gate electrode connected to the second sensing carry line, and one electrode connected to a third sensing carry line; a forty-sixth transistor having a gate electrode connected to the first control line, and one electrode connected to another electrode of the forty-fifth transistor; a forty-seventh transistor having a gate electrode connected to the third control line, one electrode connected to the second Q node, and another electrode connected to a second node; a forty-eighth transistor having a gate electrode connected to another electrode of the forty-sixth transistor, one electrode connected to the second node, and another electrode connected to the second control line; and a sixth capacitor having one electrode connected to the gate electrode of the forty-eighth transistor, and another electrode connected to the other electrode of the forty-eighth transistor.

The second scan stage may further include a forty-ninth transistor having one electrode connected to the second Q node, and a gate electrode and another electrode connected to a second scan carry line; and a fiftieth transistor having a gate electrode connected to the second Q node, one electrode connected to the second control line, and another electrode connected to the second node.

The second scan stage may further include a fifty-first transistor having a gate electrode connected to the other electrode of the forty-sixth transistor, and one electrode connected to the first power line; and a fifty-second transistor having a gate electrode connected to the third control line, one electrode connected to another electrode of the fifty-first transistor, and another electrode connected to the second QB node.

The second scan stage may further include a fifty-third transistor having a gate electrode connected to the second Q node, one electrode connected to the second QB node, and another electrode connected to the first power line; and a fifty-fourth transistor having a gate electrode connected to the first scan carry line, one electrode connected to the second QB node, and another electrode connected to the first power line.

The second scan stage may further include a fifty-fifth transistor having a gate electrode connected to the fourth control line, one electrode connected to the first power line, and another electrode connected to the second Q node; and a fifty-sixth transistor having a gate electrode connected to the first reset carry line, one electrode connected to the first power line, and another electrode connected to the second Q node.

The second scan stage may further include a fifty-seventh transistor having a gate electrode connected to the fourth control line, one electrode connected to the first power line, and another electrode connected to the gate electrode of the fifty-eighth transistor.

The fifty-seventh transistor may include a third sub-transistor having a gate electrode connected to the fourth control line, and one electrode connected to the other electrode of the forty-sixth transistor; and a fourth sub-transistor having a gate electrode connected to the fourth control line, one electrode connected to another electrode of the third sub-transistor, and another electrode connected to the first power line. The second scan stage may further include a fifty-eighth transistor having a gate electrode connected to the other electrode of the forty-sixth transistor, one electrode connected to the second control line, and another electrode connected to the one electrode of the forty-sixth transistor.

Another exemplary embodiment of the invention provides a scan driver including a plurality of scan stages. A first scan stage among the plurality of scan stages includes a first transistor having a gate electrode connected to a first Q node, one electrode connected to a first scan clock line, and another electrode connected to a first scan line; a second transistor having a gate electrode and one electrode connected to a first scan carry line, and another electrode connected to the first Q node; a third transistor having a gate electrode connected to a first sensing carry line, and one electrode connected to a first control line; a fourth transistor having a gate electrode connected to a second sensing carry line, and one electrode connected to another electrode of the third transistor; a fifth transistor having a gate electrode connected to another electrode of the fourth transistor, one electrode connected to a second control line, and another electrode connected to a first node; a first capacitor having one electrode connected to the one electrode of the fifth transistor, and another electrode connected to the gate electrode of the fifth transistor; and a sixth transistor having a gate electrode connected to a third control line, one electrode connected to the first node, and another electrode connected to the first Q node.

Another exemplary embodiment of the invention provides a scan driver including a plurality of scan stages. Odd-numbered stages among the scan stages are connected to a first sub-control line, and even-numbered stages among the scan stages are connected to a second sub-control line. A first scan stage among the plurality of scan stages includes a first transistor having a gate electrode connected to a first Q node, one electrode connected to a first scan clock line, and another electrode connected to a first scan line; a second transistor having a gate electrode and one electrode connected to a first scan carry line, and another electrode connected to the first Q node; a third transistor having a gate electrode and one electrode connected to a first sensing carry line; a fourth transistor having a gate electrode connected to the first sub-control line, and one electrode connected to another electrode of the third transistor; a fifth transistor having a gate electrode connected to another electrode of the fourth transistor, one electrode connected to a second control line, and another electrode connected to a first node; a first capacitor having one electrode connected to one electrode of the fifth transistor, and another electrode connected to the gate electrode of the fifth transistor; and a sixth transistor having a gate electrode connected to a third control line, one electrode connected to the first node, and another electrode connected to the first Q node.

A second scan stage among the plurality of scan stages may include a seventh transistor having a gate electrode connected to a second Q node, one electrode connected to a second scan clock line, and another electrode connected to a second scan line; an eighth transistor having a gate electrode and one electrode connected to a second scan carry line, and another electrode connected to the second Q node; a ninth transistor having a gate electrode and one electrode connected to a second sensing carry line; a tenth transistor having a gate electrode connected to the second sub-control line, and one electrode connected to another electrode of the ninth transistor; an eleventh transistor having a gate electrode connected to another electrode of the tenth transistor, one electrode connected to the second control line, and another electrode connected to a second node; a second capacitor having one electrode connected to the one electrode of the eleventh transistor, and another electrode connected to the gate electrode of the eleventh transistor; and a twelfth transistor having a gate electrode connected to the third control line, one electrode connected to the second node, and another electrode connected to the second Q node.

Another exemplary embodiment of the invention provides a scan driver including a plurality of scan stages. Odd-numbered stages among the scan stages are connected to a first sub-control line, and even-numbered stages among the scan stages are connected to a second sub-control line. A first scan stage among the plurality of scan stages include a first transistor having a gate electrode connected to a first Q node, one electrode connected to a first scan clock line, and another electrode connected to a first scan line; a second transistor having a gate electrode and one electrode connected to a first scan carry line, and another electrode connected to the first Q node; a third transistor having a gate electrode connected to a first sensing carry line, and one electrode connected to the first sub-control line; a fourth transistor having a gate electrode connected to the first sensing carry line, and one electrode connected to another electrode of the third transistor; a fifth transistor having a gate electrode connected to another electrode of the fourth transistor, one electrode connected to a second control line, and another electrode connected to a first node; a first capacitor having one electrode connected to the one electrode of the fifth transistor, and another electrode connected to the gate electrode of the fifth transistor; and a sixth transistor having a gate electrode connected to a third control line, one electrode connected to the first node, and another electrode connected to the first Q node.

According to the scan driver according to the inventive concepts, two or more stages may be selected by pulses of a selection signal (or a first control signal) in a display period within one frame, and in a sensing period within one frame, the two or more stages may sequentially provide scan signals (and sensing signals) to scan lines according to different clock signals (and sensing clock signals).

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
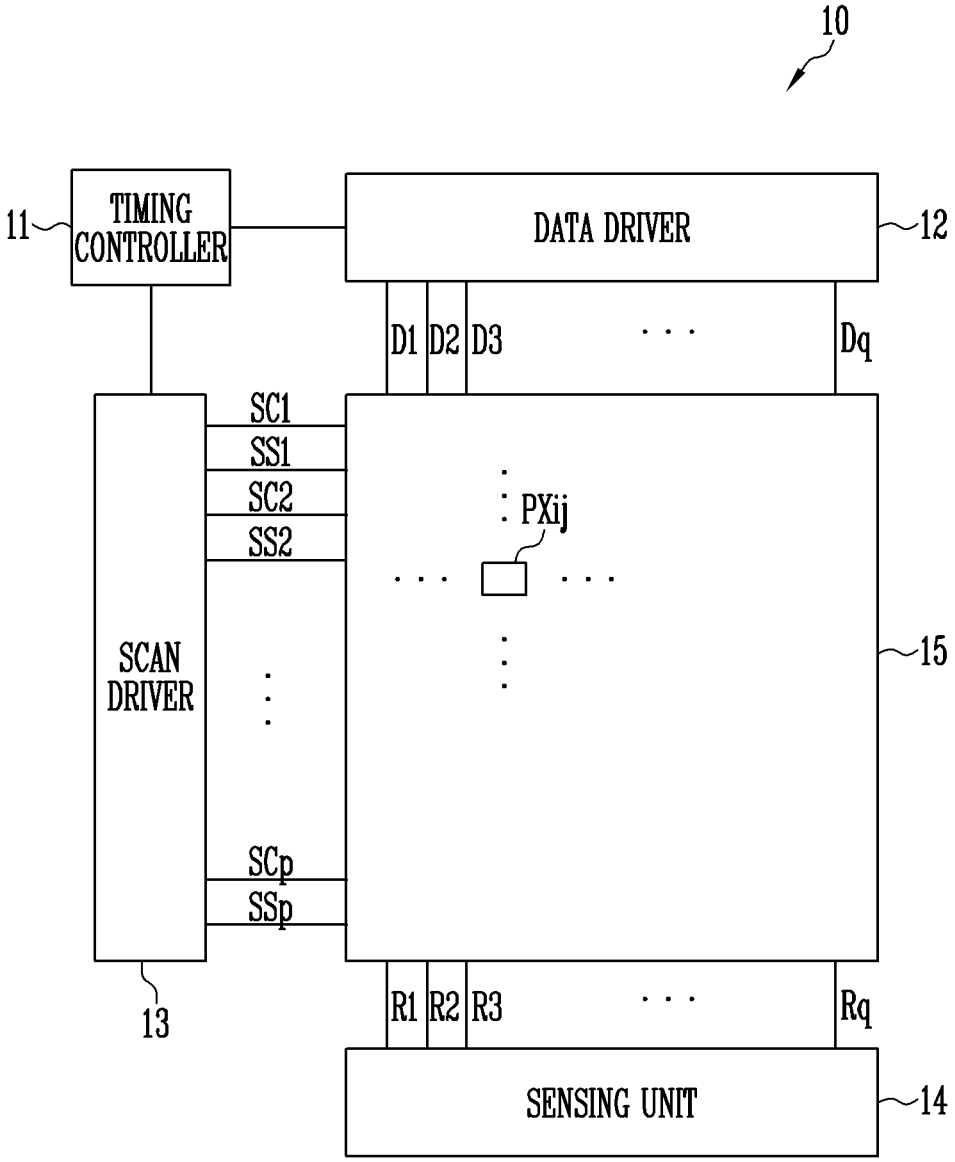
FIG. 1 is a diagram for describing a display device according to an exemplary embodiment of the invention.

In the following description, for the purposes of explanation, numerous specific details are set forth in order to provide a thorough understanding of various exemplary embodiments of the invention. As used herein "embodiments" are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

In the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As is customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a diagram for describing a display device according to an exemplary embodiment of the invention.

Referring to FIG. 1, the display device 10 may include a timing controller 11, a data driver 12, a scan driver 13, a sensing unit 14, and a pixel unit 15.

The timing controller 11 may provide grayscale values, a control signal, and the like to the data driver 12. In addition, the timing controller 11 may provide a clock signal, a control signal, and the like to each of the scan driver 13 and the sensing unit 14.

The data driver 12 may generate data signals using the grayscale values, the control signal, and the like received from the timing controller 11. For example, the data driver 12 may sample the grayscale values using a clock signal and apply the data signals corresponding to the grayscale values to data lines D1, D2, . . . Dq (where q is a positive integer) in a pixel row unit.

The scan driver 13 may receive the clock signal, the control signal, and the like from the timing controller 11 and generate scan signals to be provided to scan lines SC1, SC2, . . . SCp (where p is a positive integer). For example, the scan driver 13 may sequentially provide scan signals having a pulse of a turn-on level to the scan lines SC1 to SCp. For example, the scan driver 13 may generate the scan signals in a manner of sequentially transferring a pulse of a turn-on level to a next scan stage according to the clock signal. For example, the scan driver 13 may be configured in a form of a shift register.

In addition, the scan driver 13 may generate sensing signals to be provided to sensing lines SS1, SS2, . . . SSp. For example, the scan driver 13 may sequentially provide the sensing signals having a pulse of a turn-on level to the sensing lines SS1 to SSp. For example, the scan driver 13 may generate the sensing signals by sequentially transferring a pulse of a turn-on level to a next scan stage according to the clock signal.

Figure 5:
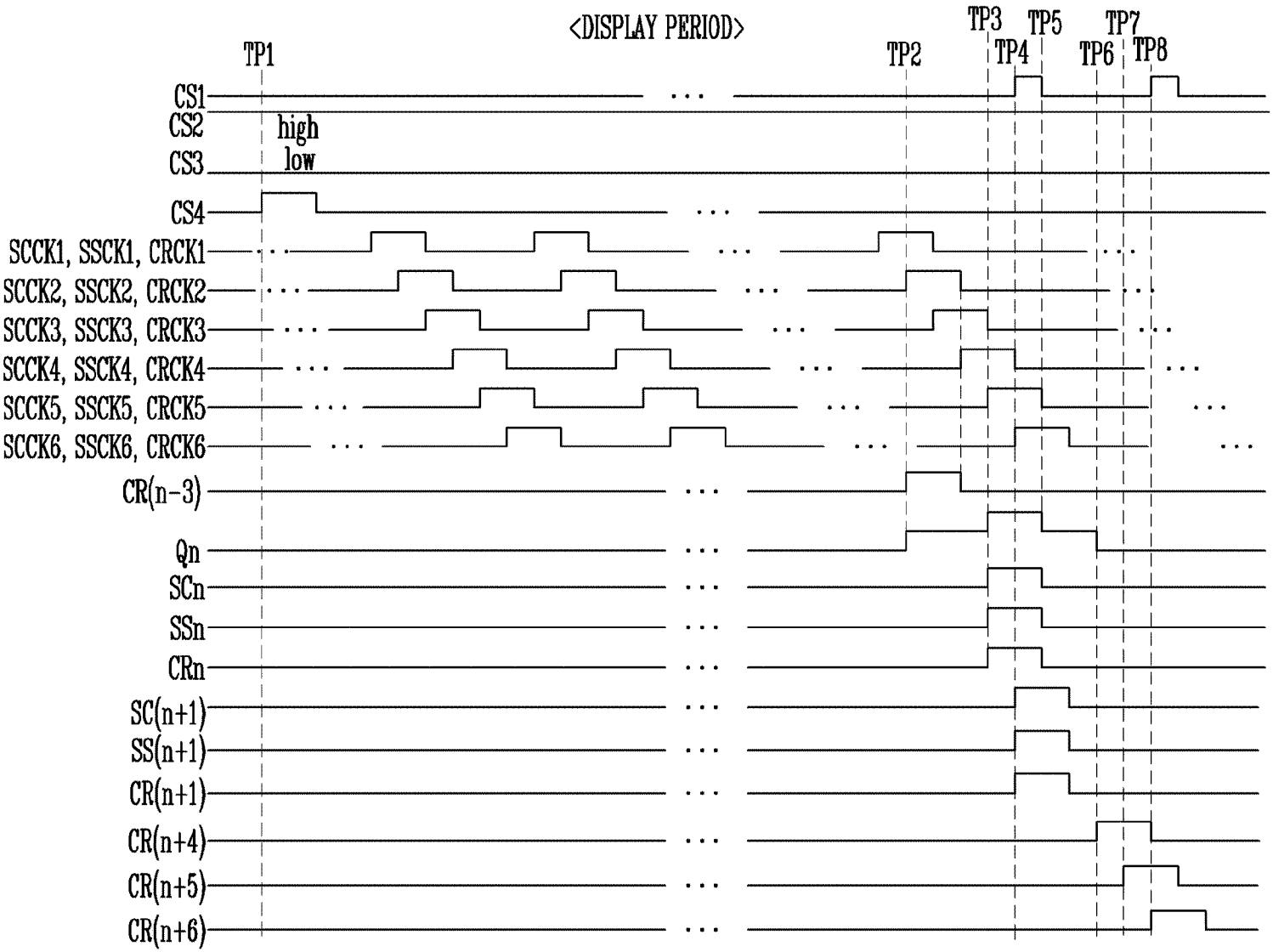
FIG. 5 is a waveform diagram illustrating a method of driving the scan driver of FIG. 3 in a display period.
Figure 7:
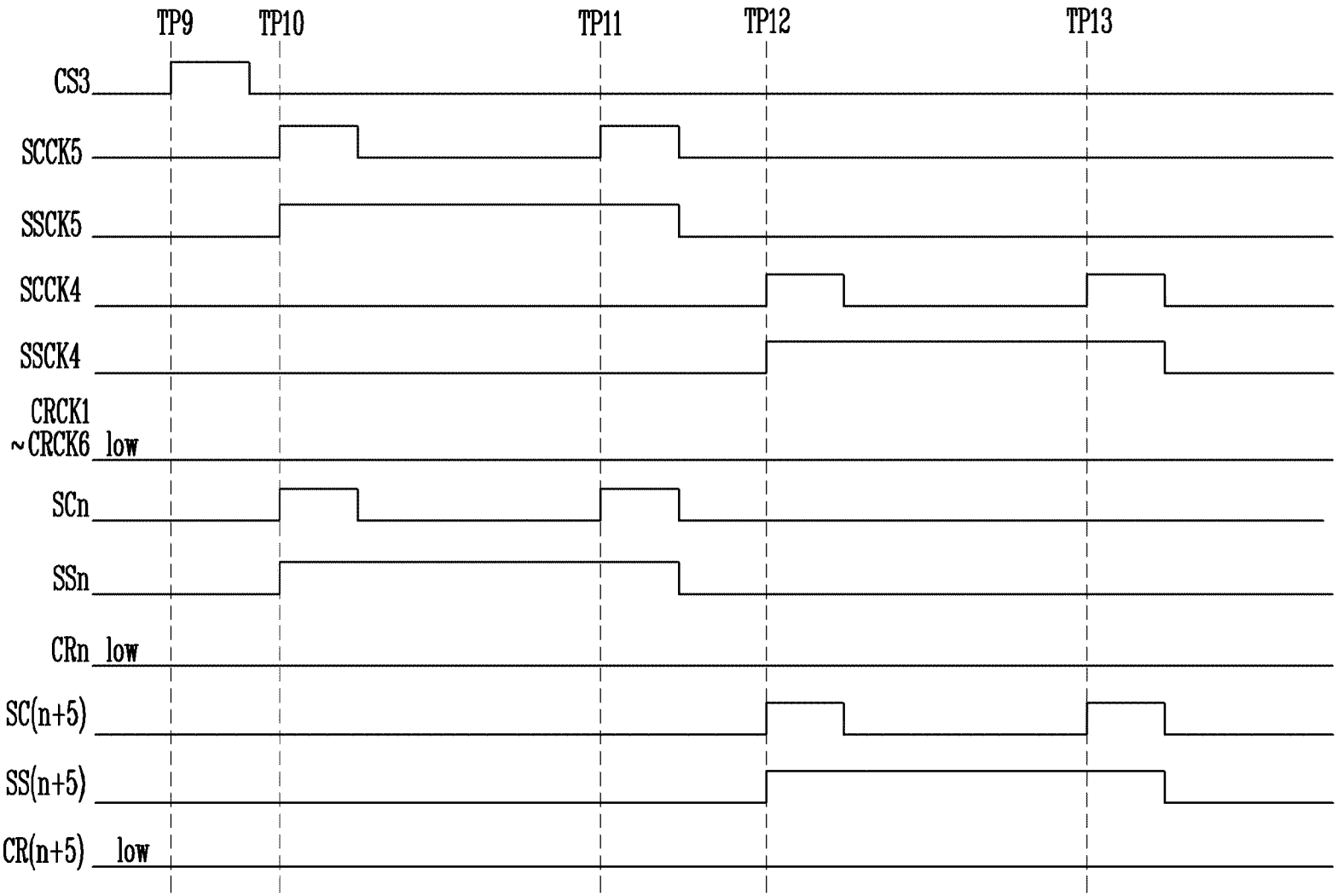
FIG. 7 is a waveform diagram illustrating a method of driving the scan driver of FIG. 3 in a sensing period.

However, an operation of the scan driver 13 described above is related to an operation in a display period of FIG. 5, and an operation in a sensing period of FIG. 7 will be separately described. One frame period (or one frame) may include one display period and one sensing period.

The sensing unit 14 may measure deterioration information of pixels according to a current or a voltage received through reception lines R1, R2, R3, . . . Rq. For example, the deterioration information of the pixels may be mobility information and threshold voltage information of driving transistors, deterioration information of a light emitting element, and the like. In addition, the sensing unit 14 may measure characteristic information of the pixels according to an environment, in accordance with the current or the voltage received through the reception lines R1 to Rq. For example, the sensing unit 14 may also measure changed characteristic information of the pixels according to temperature or humidity.

The pixel unit 15 includes the pixels. Each pixel Pxij (where each of I and j is a positive integer) may be connected to a corresponding data line, scan line, sensing line, and reception line. The pixel PXij may refer to a pixel circuit in which a scan transistor is connected to an i-th scan line and a j-th data line.

Figure 2:
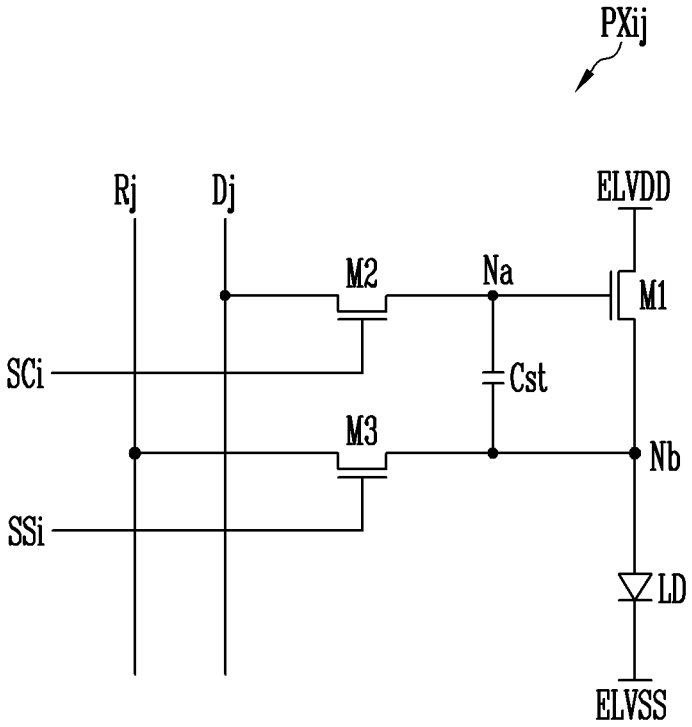
FIG. 2 is a circuit diagram illustrating an example of a pixel included in the display device of FIG. 1.

FIG. 2 is a circuit diagram illustrating an example of the pixel included in the display device of FIG. 1.

Referring to FIG. 2, the pixel PXij may include thin film transistors M1, M2, and M3 (or transistors), a storage capacitor Cst, and a light emitting element LD. The thin film transistors M1, M2, and M3 may be N-type transistors.

In the first thin film transistor M1, a gate electrode may be connected to a gate node Na, one electrode (or a first electrode) may be connected to a power line ELVDD, and another electrode (or a second electrode) may be connected to a source node Nb. The first thin film transistor M1 may be referred to as a "driving transistor".

In the second thin film transistor M2, a gate electrode may be connected to the scan line SCi, one electrode may be connected to the data line Dj, and another electrode may be connected to the gate node Na. The second thin film transistor M2 may be referred to as a switching transistor, a scan transistor, or the like.

In the third thin film transistor M3, a gate electrode may be connected to the sensing line SSi, one electrode may be connected to the reception line Rj, and another electrode may be connected to the source node Nb. The third thin film transistor M3 may be referred to as an initialization transistor, a sensing transistor, or the like.

In the storage capacitor Cst, one electrode may be connected to the gate node Na, and another electrode may be connected to the source node Nb.

In the light emitting element LD, an anode may be connected to the source node Nb and a cathode may be connected to a power line ELVSS. The light emitting element LD may be an organic light emitting diode, an inorganic light emitting diode, or the like.

Figure 3:
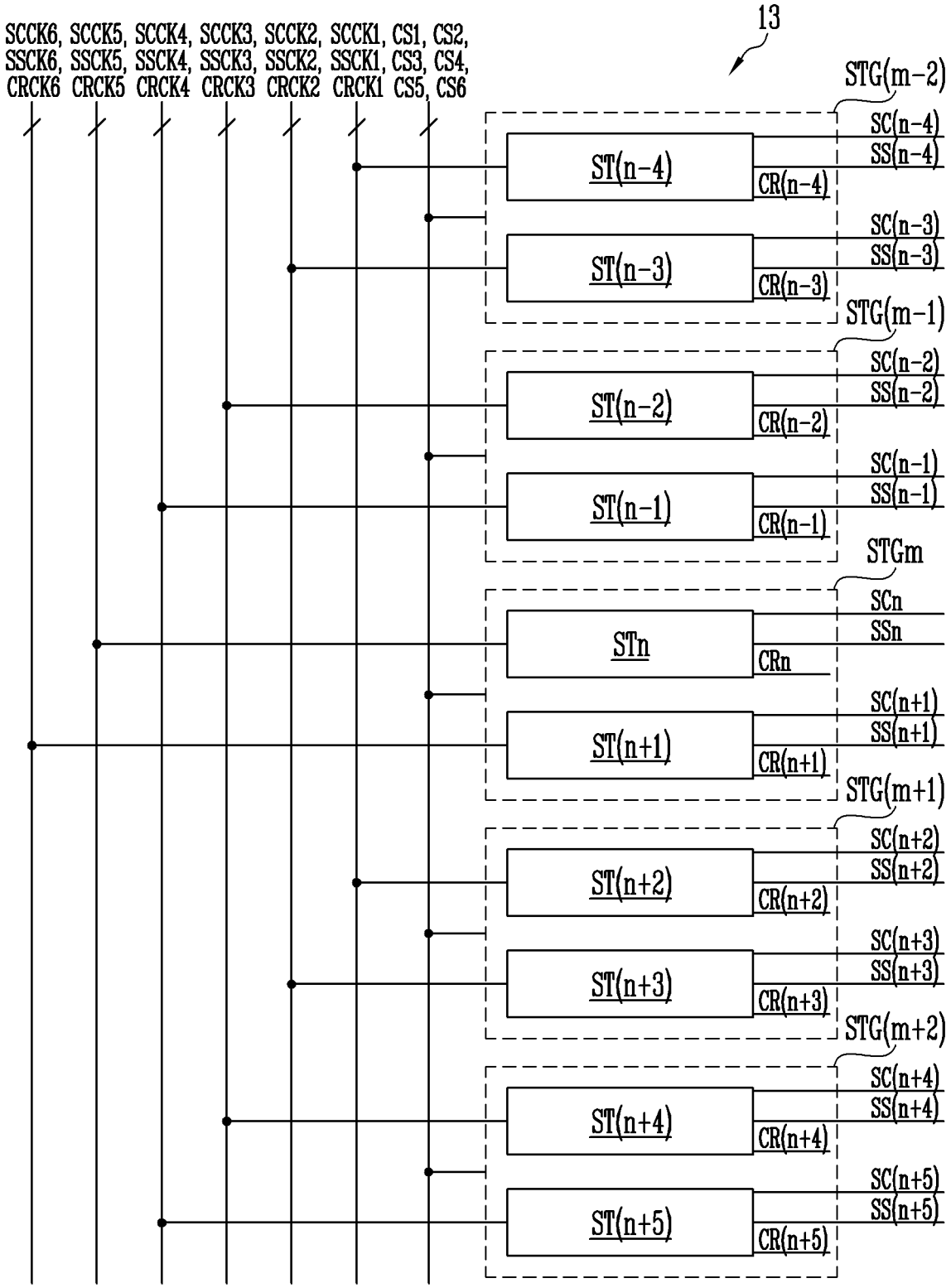
FIG. 3 is a diagram illustrating an example of a scan driver included in the display device of FIG. 1.

FIG. 3 is a diagram illustrating an example of the scan driver included in the display device of FIG. 1.

Referring to FIG. 3, the scan driver 13 includes a plurality of stage groups . . . STG(m−2), STG(m−1), STGm, STG(m+1), STG(m+2), and . . . . (where m is an integer equal to or greater than 2). FIG. 3 shows only a part of the scan driver 13 necessary for description.

Each stage group STG(m−2) to STG(m+2) may include a first scan stage and a second scan stage. The first scan stage may be an odd-numbered scan stage, and the second scan stage may be an even-numbered scan stage. For example, the (m−2)-th stage group STG(m−2) may include an (n−4)-th (where n is an integer equal to or greater than 4) scan stage ST(n−4) and an (n−3)-th-scan stage ST(n−3); the (m−1)-th stage group STG(m−1) may include an (n−2)-th scan stage ST(n−2) and an (n−1)-th-scan stage ST(n−1); the m-th stage group STGm may include an n-th scan stage STn and an (n+1)-th-scan stage ST(n+1); the (m+1)-th stage group STG(m+1) may include an (n+2)-th scan stage ST(n+2) and an (n+3)-th-scan stage ST(n+3); and the (m+2)-th stage group STG(m+2) may include an (n+4)-th scan stage ST(n+4) and an (n+5)-th-scan stage ST(n+5). Each of the (n−4)-th scan stage ST(n−4), the (n−2)-th scan stage ST(n−2), the n-th scan stage STn, the (n+2)-th scan stage ST(n+2), and the (n+4)-th scan stage ST(n+4) may be the odd-numbered scan stage, and each of the (n−3)-th-scan stage ST(n−3), the (n−1)-th-scan stage ST(n−1), the (n+1)-th-scan stage ST(n+1), the (n+3)-th-scan stage ST(n+3), and the (n+5)-th-scan stage ST(n+5) may be the even-numbered scan stage.

Each of the scan stages ST(n−4) to ST(n+5) may be connected to first-to-sixth control lines CS1, CS2, CS3, CS4, CS5, and CS6. Common control signals may be applied to the scan stages ST(n−4) to ST(n+5) through the first-to-sixth control lines CS1 to CS6.

Each of the scan stages ST(n−4) to ST(n+5) may be connected to corresponding clock lines among corresponding scan clock lines SCCK1, SCCK2, SCCK3, SCCK4, SCCK5, and SCCK6, sensing clock lines SSCK1, SSCK2, SSCK3, SSCK4, SSCK5, and SSCK6, and carry clock lines CRCK1, CRCK2, CRCK3, CRCK4, CRCK5, and CRCK6.

For example, the (n−4)-th scan stage ST(n−4) may be connected to the first scan clock line SCCK1, the first sensing clock line SSCK1, and the first carry clock line CRCK1, and (n−3)-th-scan stage ST(n−3) may be connected to the second scan clock line SCCK2, the second sensing clock line SSCK2, and the second carry clock line CRCK2. The (n−2)-th scan stage ST(n−2) may be connected to the third scan clock line SCCK3, the third sensing clock line SSCK3, and the third carry clock line CRCK3, and the (n−1)-th-scan stage ST(n−1) may be connected to the fourth scan clock line SCCK4, the fourth sensing clock line SSCK4, and the fourth carry clock line CRCK4. The n-th scan stage STn may be connected to the fifth scan clock line SCCK5, the fifth sensing clock line SSCK5, and the fifth carry clock line CRCK5, and the (n+1)-th-scan stage ST(n+1) may be connected to the sixth scan clock line SCCK6, the sixth sensing clock line SSCK6, and the sixth carry clock line CRCK6.

In addition, repeatedly, the (n+2)-th scan stage ST(n+2) may be connected to the first scan clock line SCCK1, the first sensing clock line SSCK1, and the first carry clock line CRCK1, and the (n+3)-th-scan stage ST(n+3) may be connected to the second scan clock line SCCK2, the second sensing clock line SSCK2, and the second carry clock line CRCK2. The (n+4)-th scan stage ST(n+4) may be connected to the third scan clock line SCCK3, the third sensing clock line SSCK3, and the third carry clock line CRCK3, and (n+5)-th-scan stage ST(n+5) may be connected to the fourth scan clock line SCCK4, the fourth sensing clock line SSCK4, and the fourth carry clock line CRCK4.

Input signals for the respective scan stages ST(n−4) to ST(n+5) are applied to the first-to-sixth control lines CS1 to CS6, the first-to-sixth scan clock lines SCCK1 to SCCK6, the first-to-sixth sensing clock lines SSCK1 to SSCK6, and the first-to-sixth carry clock lines CRCK1 to CRCK6.

The scan stages ST(n−4) to ST(n+5) may be connected to corresponding lines among scan lines SC(n−4), SC(n−3), SC(n−2), SC(n−1), SCn, SC(n+1), SC(n+2), SC(n+3), SC(n+4), and SC(n+5), sensing lines SS(n−4), SS(n−3), SS(n−2), SS(n−1), SSn, SS(n+1), SS(n+2), SS(n+3), SS(n+4), and SS(n+5), carry lines CR(n−4), CR(n−3), CR(n−2), CR(n−1), CRn, CR(n+1), CR(n+2), CR(n+3), CR(n+4), and CR(n+5).

For example, the (n−4)-th scan stage ST(n−4) may be connected to the (n−4)-th scan line SC(n−4), the (n−4)-th sensing line SS(n−4), and the (n−4)-th carry line CR(n−4); and the (n−3)-th scan stage ST(n−3) may be connected to the (n−3)-th scan line SC(n−3), the (n−3)-th sensing line SS(n−3), and the (n−3)-th carry line CR(n−3). The (n−2)-th scan stage ST(n−2) may be connected to the (n−2)-th scan line SC(n−2), the (n−2)-th sensing line SS(n−2), and the (n−2)-th carry line CR(n−2); and the (n−1)-th scan stage ST(n−1) may be connected to the (n−1)-th scan line SC(n−1), the (n−1)-th sensing line SS(n−1), and the (n−1)-th carry line CR(n−1). The n-th scan stage STn may be connected to the n-th scan line SCn, the n-th sensing line SSn, and the n-th carry line CRn; and the (n+1)-th scan stage ST(n+1) may be connected to the (n+1)-th scan line SC(n+1), the (n+1)-th sensing line SS(n+1), and the (n+1)-th carry line CR(n+1). The (n+2)-th scan stage ST(n+2) may be connected to the (n+2)-th scan line SC(n+2), the (n+2)-th sensing line SSn, and the (n+2)-th carry line CR(n+2); and the (n+3)-th scan stage ST(n+3) may be connected to the (n+3)-th scan line SC(n+3), the (n+3)-th sensing line SS(n+3), and the (n+3)-th carry line CR(n+3). The (n+4)-th scan stage ST(n+4) may be connected to the (n+4)-th scan line SC(n+4), the (n+4)-th sensing line SSn, and the (n+4)-th carry line CR(n+4); and the (n+5)-th scan stage ST(n+5) may be connected to the (n+5)-th scan line SC(n+5), the (n+5)-th sensing line SS(n+5), and the (n+5)-th carry line CR(n+5).

Output signals generated by the respective scan stages ST(n−4) to ST(n+5) are applied to the scan lines SC(n−4) to SC(n+5), the sensing lines SS(n−4) to SS(n+5), and the carry lines CR(n−4) to CR(n+5).

Figure 4:
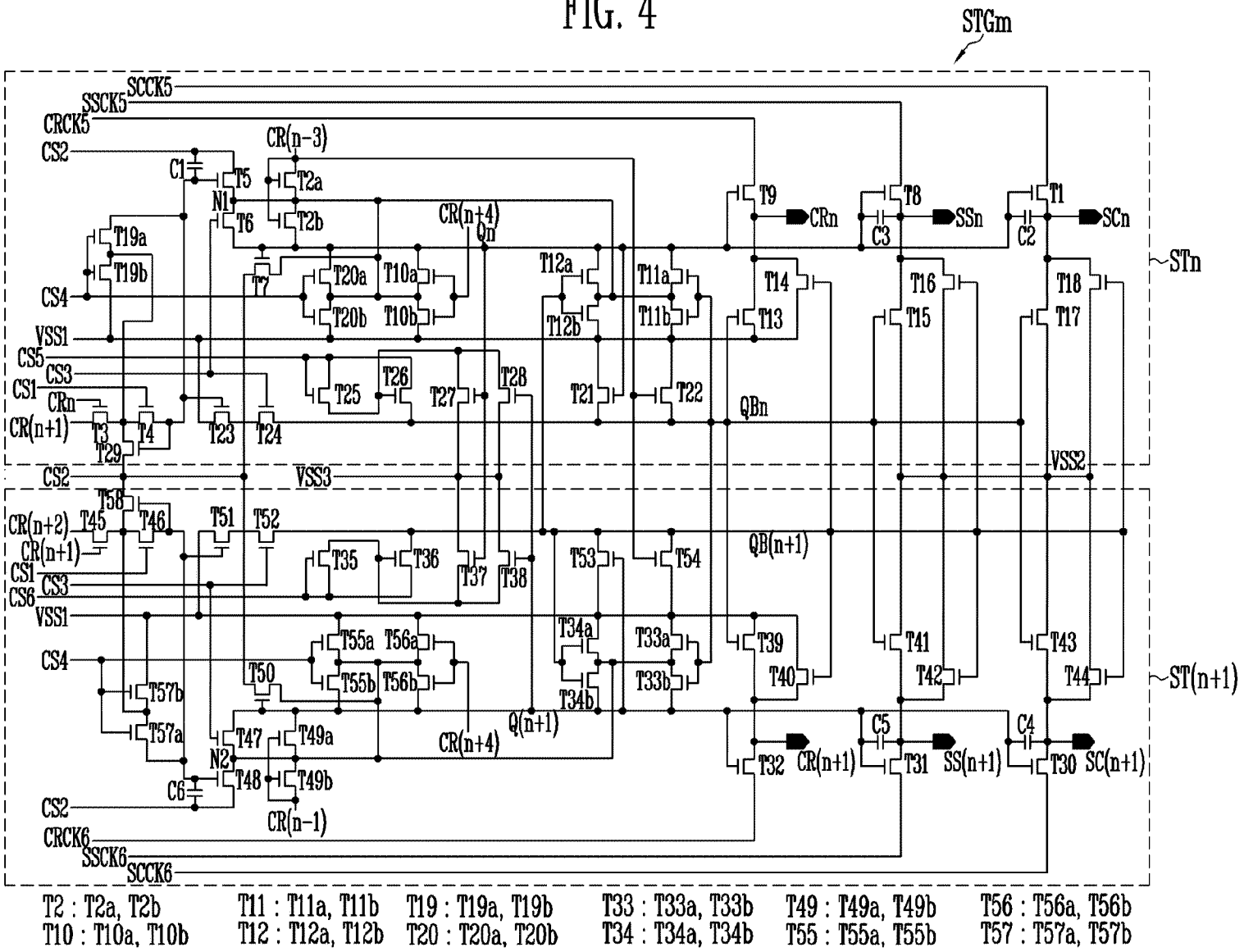
FIG. 4 is a circuit diagram illustrating an example of an m-th stage group included in the scan driver of FIG. 3.

FIG. 4 is a circuit diagram illustrating an example of the m-th stage group included in the scan driver of FIG. 3.

Referring to FIG. 4, the m-th stage group STGm includes an n-th scan stage STn (or a first scan stage) and an (n+1)-th scan stage ST(n+1) (or a second scan stage). The other stage groups STG(m−2), STG(m−1), STG(m+1), and STG(m+2) described with reference to FIG. 3 may include substantially the same configuration as the m-th stage group STGm.

First, the n-th scan stage STn (or the first scan stage) may include transistors T1 to T29 and capacitors C1 to C3. Hereinafter, description will be given under an assumption that the transistors T1 to T58 are N-type transistors (for example, NMOS). However, those skilled in the art may configure the stage group STGm by replacing some or all of the transistors T1 to T58 with P-type transistors (for example, PMOS).

In the first transistor T1, a gate electrode may be connected to a first Q node Qn, one electrode may be connected to the fifth scan clock line SCCK5, and another electrode may be connected to the n-th scan line SCn (or first scan line).

In the second transistor T2, a gate electrode and one electrode may be connected to the (n−3)-th carry line CR(n−3) (or the first scan carry line), and another electrode may be connected to the first Q node Qn. For example, a carry signal output from the (n−3)-th scan stage ST(n−3) may be applied to the (n−3)-th carry line CR(n−3).

In an exemplary embodiment, the second transistor T2 may include a first sub-transistor T2*a* and a second sub-transistor T2*b* connected in series. A gate electrode and one electrode of the first sub-transistor T2*a* may be connected to the (n−3)-th carry line CR(n−3), and another electrode may be connected to a first node N1. A gate electrode of the second sub-transistor T2*b* may be connected to the (n−3)-th carry line CR(n−3), one electrode may be connected to the first node N1, and another electrode may be connected to the first Q node Qn.

In the third transistor T3, a gate electrode may be connected to the n-th carry line CRn (or first sensing carry line), one electrode may be connected to the (n+1)-th carry line CR(n+1) (or second sensing carry line), and another electrode may be connected to one electrode of the fourth transistor T4. For example, a carry signal output from the n-th scan stage STn may be applied to the n-th carry line CRn, and a carry signal output from the (n+1)-th scan stage ST(n+1) may be applied to the (n+1)-th carry line CR(n+1).

In the fourth transistor T4, a gate electrode may be connected to the first control line CS1, one electrode may be connected to the other electrode of the third transistor T3, and another electrode may be connected to another electrode of the first capacitor C1.

In the fifth transistor T5, a gate electrode may be connected to the other electrode of the fourth transistor T4, one electrode may be connected to the second control line CS2, and another electrode may be connected to the first node N1.

In the first capacitor C1, one electrode may be connected to the one electrode of the fifth transistor T5, and the other electrode may be connected to the gate electrode of the fifth transistor T5.

In the sixth transistor T6, a gate electrode may be connected to the third control line CS3, one electrode may be connected to the first node N1, and another electrode may be connected to the first Q node Qn.

In the seventh transistor T7, a gate electrode may be connected to the first Q node Qn, one electrode may be connected to the second control line CS2, and another electrode may be connected to the first node N1.

In the second capacitor C2, one electrode may be connected to the gate electrode of the first transistor T1, and another electrode may be connected to the other electrode of the first transistor T1.

In the eighth transistor T8, a gate electrode may be connected to the first Q node Qn, one electrode may be connected to the fifth sensing clock line SSCK5, and another electrode may be connected to the n-th sensing line SSn (or first sensing line).

In the third capacitor C3, one electrode may be connected to the gate electrode of the eighth transistor T8, and another electrode may be connected to the other electrode of the eighth transistor T8.

In the ninth transistor T9, a gate electrode may be connected to the first Q node Qn, one electrode may be connected to the fifth carry clock line CRCK5, and another electrode may be connected to the n-th carry line CRn (or first carry line).

In the tenth transistor T10, a gate electrode may be connected to the (n+4)-th carry line CR(n+4) (or first reset carry line), one electrode may be connected to the first Q node Qn, and another electrode may be connected to a first power line VSS1. For example, a carry signal output from the (n+4)-th scan stage ST(n+4) may be applied to the (n+4)-th carry line CR(n+4).

In an exemplary embodiment, the tenth transistor T10 may include a third sub-transistor T10*a* and a fourth sub-transistor T10*b* connected in series. A gate electrode of the third sub-transistor T10*a* may be connected to the (n+4)-th carry line CR(n+4), one electrode may be connected to the first Q node Qn, and another electrode may be connected to the first node N1. A gate electrode of the fourth sub-transistor T10*b* may be connected to the (n+4)-th carry line CR(n+4), one electrode may be connected to the first node N1, and another electrode may be connected to the first power line VSS1.

In the eleventh transistor T11, a gate electrode may be connected to a first QB node QBn, one electrode may be connected to the first Q node Qn, and another electrode may be connected to the first power line VSS1.

In an exemplary embodiment, the eleventh transistor T11 may include a fifth sub-transistor T11*a* and a sixth sub-transistor T11*b* connected in series. In the fifth sub-transistor T11*a*, a gate electrode may be connected to the first QB node QBn, one electrode may be connected to the first Q node Qn, and another electrode may be connected to the first node N1. In the sixth sub-transistor T11*b*, a gate electrode may be connected to the first QB node QBn, one electrode may be connected to the first node N1, and another electrode may be connected to the first power line VSS1.

In the twelfth transistor T12, a gate electrode may be connected to a second QB node QB(n+1), one electrode may be connected to the first Q node Qn, and another electrode may be connected to the first power line VSS1.

In an exemplary embodiment, the twelfth transistor T12 may include a seventh sub-transistor T12*a* and an eighth sub-transistor T12*b* connected in series. In the seventh sub-transistor T12*a*, a gate electrode may be connected to the second QB node QB(n+1), one electrode may be connected to the first Q node Qn, and another electrode may be connected to the first node N1. In the eighth sub-transistor T12*b*, a gate electrode may be connected to the second QB node QB(n+1), one electrode may be connected to the first node N1, and another electrode may be connected to the first power line VSS1.

In the thirteenth transistor T13, a gate electrode may be connected to the first QB node QBn, one electrode may be connected to the n-th carry line CRn, and another electrode may be connected to the first power line VSS1.

In the fourteenth transistor T14, a gate electrode may be connected to the second QB node QB(n+1), one electrode may be connected to the n-th carry line CRn, and another electrode may be connected to the first power line VSS1.

In the fifteenth transistor T15, a gate electrode may be connected to the first QB node QBn, one electrode may be connected to the n-th sensing line SSn, and another electrode may be connected to a second power line VSS2.

In the sixteenth transistor T16, a gate electrode may be connected to the second QB node QB(n+1), one electrode may be connected to the n-th sensing line SSn, and another electrode may be connected to the second power line VSS2.

In the seventeenth transistor T17, a gate electrode may be connected to the first QB node QBn, one electrode may be connected to the n-th scan line SCn, and another electrode may be connected to the second power line VSS2.

In the eighteenth transistor T18, a gate electrode may be connected to the second QB node QB(n+1), one electrode may be connected to the n-th scan line SCn, and another electrode may be connected to the second power line VSS2.

In the nineteenth transistors T19*a* and T19*b*, a gate electrode may be connected to the fourth control line CS4, and one electrode may be connected to the gate electrode of the fifth transistor T5 (or the other electrode of the first capacitor C1), and another electrode may be connected to the first power line VSS1.

In an exemplary embodiment, the nineteenth transistors T19*a* and T19*b* may include a ninth sub-transistor T19*a* and a tenth sub-transistor T19*b* connected in series. In the ninth sub-transistor T19*a*, a gate electrode may be connected to the fourth control line CS4, and one electrode may be connected to the gate electrode of the fifth transistor T5 (or the other electrode of the first capacitor C1), and another electrode may be connected to one electrode of the tenth sub-transistor T19*b* (or the other electrode of the third transistor T3). In the tenth sub-transistor T19*b*, a gate electrode may be connected to the fourth control line CS4, one electrode may be connected to the other electrode of the ninth sub-transistor T19*a*, and another electrode may be connected to the first power line VSS1.

In the twentieth transistors T20*a* and T20*b*, a gate electrode may be connected to the fourth control line CS4, one electrode may be connected to the first Q node Qn, and another electrode may be connected to the first power line VSS1.

In an exemplary embodiment, the twentieth transistor may include an eleventh sub-transistor T20*a* and a twelfth sub-transistor T20*b* connected in series. In the eleventh sub-transistor T20*a*, a gate electrode may be connected to the fourth control line CS4, one electrode may be connected to the first Q node Qn, and another electrode may be connected to the first node N1. In the twelfth sub-transistor T20*b*, a gate electrode may be connected to the fourth control line CS4, one electrode may be connected to the first node N1, and another electrode may be connected to the first power line VSS1.

In the twenty-first transistor T21, a gate electrode may be connected to the first Q node Qn, one electrode may be connected to the first power line VSS1, and another electrode may be connected to the first QB node QBn.

In the twenty-second transistor T22, a gate electrode may be connected to the (n−3)-th carry line CR(n−3) (or first scan carry line), one electrode may be connected to the first power supply line VSS1, and another electrode may be connected to the first QB node QBn.

In the twenty-third transistor T23, a gate electrode may be connected to the other electrode of the fourth transistor T4 (or the other electrode of the first capacitor C1), one electrode may be connected to the first power line VSS1, and another electrode may be connected to one electrode of the twenty-fourth transistor T24.

In the twenty-fourth transistor T24, a gate electrode may be connected to the third control line CS3, one electrode may be connected to the other electrode of the twenty-third transistor T23, and another electrode may be connected to the first QB node QBn.

In the twenty-fifth transistor T25, a gate electrode and one electrode may be connected to the fifth control line CS5, and another electrode may be connected to a gate electrode of the twenty-six transistor T26.

In the twenty-sixth transistor T26, the gate electrode may be connected to the other electrode of the twenty-fifth transistor T25, one electrode may be connected to the fifth control line CS5, and another electrode may be connected to the first QB node QBn.

In the twenty-seventh transistor T27, a gate electrode may be connected to the first Q node Qn, one electrode may be connected to the gate electrode of the twenty-six transistor T26, and another electrode may be connected to a third power line VSS3.

In the twenty-eighth transistor T28, a gate electrode may be connected to the second Q node Q(n+1), one electrode may be connected to the gate electrode of the twenty-six transistor T26, and another electrode may be connected to the third power line VSS3.

In the twenty-ninth transistor T29, a gate electrode may be connected to the other electrode of the fourth transistor T4, one electrode may be connected to the one electrode of the fourth transistor T4, and another electrode may be connected to the second control line CS2.

Next, the (n+1)-th scan stage ST(n+1) (or second scan stage) may include transistors T30 to T58 and capacitors C4 to C6.

In the thirtieth transistor T30, a gate electrode may be connected to the second Q node Q(n+1), and one electrode may be connected to the (n+1)-th scan line SC(n+1) (or second scan line), and another electrode may be connected to the sixth scan clock line SCCK6.

The fourth capacitor C4 may connect the gate electrode and the one electrode of the thirtieth transistor T30.

In the thirty-first transistor T31, a gate electrode may be connected to a second Q node Q(n+1), and one electrode may be connected to the (n+1)-th sensing line SS(n+1) (or second sensing line), and another electrode may be connected to the sixth sensing clock line SSCK6.

The fifth capacitor C5 may connect the gate electrode and the one electrode of the thirty-first transistor T31.

In the thirty-second transistor T32, a gate electrode may be connected to the second Q node Q(n+1), one electrode may be the (n+1)-th carry line CR(n+1) (or second carry line), and another electrode may be connected to the sixth carry clock line CRCK6.

In the thirty-third transistor T33, a gate electrode may be connected to the first QB node QBn, one electrode may be connected to the first power line VSS1, and another electrode may be connected to the second Q node Q(n+1).

In an exemplary embodiment, the thirty-third transistor T33 may include a thirteenth sub-transistor T33*a* and a fourteenth sub-transistor T33*b*. In the thirteenth sub-transistor T33*a*, a gate electrode may be connected to the first QB node QBn, one electrode may be connected to the first power line VSS1, and another electrode may be connected to a second node N2. In the fourteenth sub-transistor T33*b*, a gate electrode may be connected to the first QB node QBn, one electrode may be connected to the second node N2, and another electrode may be connected to the second Q node Q(n+1).

In the thirty-fourth transistor T34, a gate electrode may be connected to the second QB node QB(n+1), one electrode may be connected to the first power line VSS1, and another electrode may be connected to the second Q node Q(n+1).

In an exemplary embodiment, the thirty-fourth transistor T34 may include a fifteenth sub-transistor T34*a* and a sixteenth sub-transistor T34*b*. In the fifteenth sub-transistor T34*a*, a gate electrode may be connected to the second QB node QB(n+1), one electrode may be connected to the first power line VSS1, and another electrode may be connected to the second node N2. In the sixteenth sub-transistor T34*b*, a gate electrode may be connected to the second QB node QB(n+1), one electrode may be connected to the second node N2, and another electrode may be connected to the second Q node Q(n+1).

In the thirty-fifth transistor T35, a gate electrode may be connected to the sixth control line CS6, one electrode may be connected to a gate electrode of the thirty-sixth transistor T36, and another electrode may be connected to the sixth control line CS6.

In the thirty-sixth transistor T36, the gate electrode may be connected to the one electrode of the thirty-fifth transistor T35, one electrode may be connected to the second QB node QB(n+1), and another electrode may be connected to the sixth control line CS6.

In the thirty-seventh transistor T37, a gate electrode may be connected to the first Q node Qn, one electrode may be connected to the third power line VSS3, and another electrode may be connected to the gate electrode of the thirty-sixth transistor T36.

In the thirty-eighth transistor T38, a gate electrode may be connected to the second Q node Q(n+1), one electrode may be connected to the third power line VSS3, and another electrode may be connected to the gate electrode of the thirty-sixth transistor T36.

In the thirty-ninth transistor T39, a gate electrode may be connected to the first QB node QBn, one electrode may be connected to the first power line VSS1, and another electrode may be the (n+1)-th carry line CR(n+1).

In the fortieth transistor T40, a gate electrode may be connected to the second QB node QB(n+1), one electrode may be connected to the first power line VSS1, and another electrode may be connected to the (n+1)-th carry line CR(n+1).

In the forty-first transistor T41, a gate electrode may be connected to the first QB node QBn, one electrode may be connected to the second power supply line VSS2, and another electrode may be connected to the (n+1)-th sensing line SS(n+1).

In the forty-second transistor T42, a gate electrode may be connected to the second QB node QB(n+1), one electrode may be connected to the second power line VSS2, and another electrode may be the (n+1)-th sensing line SS(n+1).

In the forty-third transistor T43, a gate electrode may be connected to the first QB node QBn, one electrode may be connected to the second power line VSS2, and another electrode may be the (n+1)-th scan line SC(n+1).

In the forty-fourth transistor T44, a gate electrode may be connected to the second QB node QB(n+1), one electrode may be connected to the second power line VSS2, and another electrode may be connected to the (n+1)-th scan line SC(n+1).

In the forty-fifth transistor T45, a gate electrode may be connected to the (n+1)-th carry line CR(n+1) (or second sensing carry line), one electrode may be connected to the (n+2)-th carry line CR(n+2) (or third sensing carry line), and another electrode may be connected to one electrode of the forty-sixth transistor T46. For example, a carry signal output from the n-th scan stage STn may be applied to the n-th carry line CRn, a carry signal output from the (n+1)-th scan stage ST(n+1) may be applied to the (n+1)-th carry line CR(n+1), and a carry signal output from the (n+2)-th scan stage ST(n+2) may be applied to the (n+2)-th carry line CR(n+2).

In the forty-sixth transistor T46, a gate electrode may be connected to the first control line CS1, one electrode may be connected to the other electrode of the forty-fifth transistor T45, and another electrode may be connected to one electrode of the sixth capacitor C6.

The forty-seventh transistor T47, a gate electrode may be connected to the third control line CS3, one electrode may be connected to the second Q node Q(n+1), and another electrode may be connected to the second node N2.

In the forty-eighth transistor T48, a gate electrode may be connected to the other electrode of the forty-sixth transistor T46 (or the one electrode of the sixth capacitor C6), and one electrode may be connected to the second node N2, and another electrode may be connected to the second control line CS2.

In the sixth capacitor C6, the one electrode may be connected to the gate electrode of the forty-eighth transistor T48, and another electrode may be connected to the other electrode of the forty-eighth transistor T48.

In the forty-ninth transistor T49, one electrode may be connected to the second Q node Q(n+1), and a gate electrode and another electrode may be connected to the (n−1)-th carry line CR(n−1). A carry signal output from the (n−1)-th scan stage ST(n−1) may be applied to the (n−1)-th carry line CR(n−1).

In an exemplary embodiment, the forty-ninth T49 may include a seventeenth sub-transistor T49*a* and an eighteenth sub-transistor T49*b* connected in series. In the seventeenth sub-transistor T49*a*, a gate electrode may be connected to the (n−1)-th carry line CR(n−1), one electrode may be connected to the second Q node Q(n+1), and another electrode may be connected to the second node N2. In the eighteenth sub-transistor T49*b*, a gate electrode may be connected to the (n−1)-th carry line CR(n−1), one electrode may be connected to the second node N2, and another electrode may be connected to the (n−1)-th carry line CR(n−1).

In the fiftieth transistor T50, a gate electrode may be connected to the second Q node Q(n+1), one electrode may be connected to the second control line CS2, and another electrode may be connected to the second node N2.

In the fifty-first transistor T51, a gate electrode may be connected to another electrode of the forty-sixth transistor T46, one electrode may be connected to the first power line VSS1, and another electrode may be connected to one electrode of the fifty-second transistor T52.

In the fifty-second transistor T52, a gate electrode may be connected to the third control line CS3, one electrode may be connected to the other electrode of the fifty-first transistor T51, and another electrode may be connected to the second QB node QB(n+1).

In the fifty-third transistor T53, a gate electrode may be connected to the second Q node Q(n+1), one electrode may be connected to the second QB node QB(n+1), and another electrode may be connected to the first power line VSS1.

In the fifty-fourth transistor T54, a gate electrode may be connected to the (n−3)-th carry line CR(n−3), one electrode may be connected to the second QB node QB(n+1), and another electrode may be connected to the first power line VSS1.

In the fifty-fifth transistor T55, a gate electrode may be connected to the fourth control line CS4, one electrode may be connected to the first power line VSS1, and another electrode may be connected to the second Q node Q(n+1).

In an exemplary embodiment, the fifty-fifth transistor T55 may include a nineteenth sub-transistor T55*a* and a twentieth sub-transistor T55*b* connected in series. In the nineteenth sub-transistor T55*a*, a gate electrode may be connected to the fourth control line CS4, one electrode may be connected to the first power line VSS1, and another electrode may be connected to the second node N2. In the twentieth sub-transistor T55*b*, a gate electrode may be connected to the fourth control line CS4, one electrode may be connected to the second node N2, and another electrode may be connected to the second Q node Q(n+1).

In the fifty-sixth transistor T56, a gate electrode may be connected to the (n+4)-th carry line CR(n+4) (or first reset carry line), one electrode may be connected to the first power line VSS1, and another electrode may be connected to the second Q node Q(n+1).

In an exemplary embodiment, the fifty-sixth transistor T56 may include a twenty-first sub-transistor T56*a* and a twenty-second sub-transistor T56*b*. In the twenty-first sub-transistor T56*a*, a gate electrode may be connected to the (n+4)-th carry line CR(n+4), one electrode may be connected to the first power line VSS1, and another electrode may be connected to the second node N2. In the twenty-second sub-transistor T56*b*, a gate electrode may be connected to an (n+4)-th carry line CR(n+4), one electrode may be connected to a second node N2, and another electrode may be connected to the second Q node Q(n+1).

In the fifty-seventh transistor T57, a gate electrode may be connected to the fourth control line CS4, one electrode may be connected to the gate electrode of the forty-eighth transistor T48 (or the one electrode of the sixth capacitor C6), and another electrode may be connected to the first power line VSS1.

In an exemplary embodiment, the fifty-seventh transistor T57 may include a twenty-third sub-transistor T57*a* and a twenty-fourth sub-transistor T57*b*. In the twenty-third sub-transistor T57*a*, a gate electrode may be connected to the fourth control line CS4, one electrode may be connected to the gate electrode of the forth-eighth transistor T48 (or the one electrode of the sixth capacitor C6), and another electrode may be connected to one electrode of the twenty-fourth sub-transistor T57*b* (or the other electrode of the forty-fifth transistor T45). In the twenty-fourth sub-transistor T57*b*, a gate electrode may be connected to the fourth control line CS4, the one electrode may be connected to the other electrode of the twenty-third sub-transistor T57*a*, and another electrode may be connected to the first power line VSS1.

In the fifty-eighth transistor T58, a gate electrode may be connected to the other electrode of the forty-sixth transistor T46, one electrode may be connected to the second control line CS2, and another electrode connected to the one electrode of the forty-sixth transistor T46.

FIG. 5 is a waveform diagram illustrating a method of driving the scan driver of FIG. 3 in the display period.

First, referring to FIGS. 3 to 5, signals applied to the first control line CS1, the second control line CS2, the third control line CS3, the fourth control line CS4, the scan clock lines SCCK1 to SCCK6, the sensing clock lines SSCK1 to SSCK6, the carry clock lines CRCK1 to CRCK6, the (n−3)-th carry line CR(n−3) (or first scan carry line), the n-th scan line SCn (or first scan line), the (n+1)-th scan line SC(n+1) (or second scan line), the n-th sensing line SSn (or first sensing line), the (n+1)-th sensing line SS(n+1) (or second sensing line), the n-th carry line CRn (first carry line, or first sensing carry line), and the (n+1)-th carry line CR(n+1) (second carry line, or second sensing carry line) are shown.

In the display period, phases of the scan clock signal, the sensing clock signal, and the carry clock signal applied to the respective scan clock line, sensing clock line, and carry clock line connected to the same scan stage may be the same. Therefore, in FIG. 5, signals of the first clock lines SCCK1, SSCK1, and CRCK1 are commonly shown, signals of the second clock lines SCCK2, SSCK2, and CRCK2 are commonly shown, signals of the third clock lines SCCK3, SSCK3, and CRCK3 are commonly shown, signals of the fourth clock lines SCCK4, SSCK4 and CRCK4 are commonly shown, signals of the fifth clock lines SCCK5, SSCK5 and CRCK5 are commonly shown, and signals of the sixth clock lines SCCK6, SSCK6, CRCK6 are commonly shown.

However, magnitudes of the scan clock signal, the sensing clock signal, and the carry clock signal applied to the respective scan clock line, sensing clock line, and carry clock line connected to the same scan stage may be different from each other. For example, a low level (or logic low level) of the scan clock signals and the sensing clock signals may correspond to a magnitude of a voltage applied to the second power line VSS2, and a high level (or logic high level) may correspond to a magnitude of a turn-on voltage. In addition, a low level of the carry clock signals may correspond to a magnitude of a voltage applied to the first power line VSS1 or the third power line VSS3, and a high level may correspond to a magnitude of the turn-on voltage. For example, the voltage applied to the second power line VSS2 may be greater than the voltage applied to the first power line VSS1 or the third power line VSS3.

The magnitude of the turn-on voltage is high enough to turn on the transistors, and the voltages applied to the power lines VSS1, VSS2, and VSS3 may be large enough to turn off the transistors. Hereinafter, a voltage level corresponding to the magnitude of the turn-on voltage may be expressed as a high level, and a voltage level corresponding to the magnitude of voltages applied to the power lines VSS1, VSS2, and VSS3 may be expressed as a low level.

Pulses of the high level of the second clock lines SCCK2, SSCK2, and CRCK2 may be delayed in phase more than pulses of the high level of the first clock lines SCCK1, SSCK1, and CRCK1, and may be partially overlapped in time. For example, the pulses of the high level may have a length (or width) of two horizontal periods, and the overlapping length may correspond to one horizontal period. For example, the pulses of the high level of the second clock lines SCCK2, SSCK2 and CRCK2 may be delayed by one horizontal period more than pulses of the high level of the first clock lines SCCK1, SSCK1 and CRCK1.

Similarly, pulses of the high level of the third clock lines SCCK3, SSCK3, and CRCK3 may be delayed in phase more than the pulses of the high level of the second clock lines SCCK2, SSCK2 and CRCK2, and may be partially overlapped in time. Pulses of the high level of the fourth clock lines SCCK4, SSCK4, and CRCK4 may be delayed in phase more than the pulses of the high level of the third clock lines SCCK3, SSCK3, and CRCK3, and partially overlapped in time. Pulses of the high level of the fifth clock lines SCCK5, SSCK5, and CRCK5 may be delayed in phase more than the pulses of the high level of the fourth clock lines SCCK4, SSCK4, and CRCK4, but may be partially overlapped in time. Pulses of the high level of the sixth clock lines SCCK6, SSCK6, and CRCK6 may be delayed in phase more than the pulses of the high level of the fifth clock lines SCCK5, SSCK5, and CRCK5, and may be partially overlapped in time. In addition, repeatedly, the pulses of the high level of the first clock lines SCCK1, SSCK1, and CRCK1 may be delayed in phase, and may be partially overlapped in time.

Hereinafter, an operation of the n-th scan stage STn in the display period will be described. Since an operation of the other scan stages is similar to that of the n-th scan stage STn, repetitive description will be omitted.

At a first time point TP1, a pulse of the high level may be applied to the fourth control line CS4. In this case, the twentieth transistors T20*a* and T20*b* may be turned on and the first Q node Qn may be discharged to the low level. In addition, the nineteenth transistors T19*a* and T19*b* may be turned on and the first capacitor C1 may be discharged. For example, a voltage written to the first capacitor C1 and the gate electrode of the fifth transistor T5 may be reset.

At a second time point TP2, a pulse of the high level may occur in the (n−3)-th carry line CR(n−3). In this case, the second transistors T2*a* and T2*b* may be turned on and the first Q node Qn may be charged to the high level. The seventh transistor T7 may be turned on in response to a node voltage of the first Q node Qn, and the first node N1 may be charged to the high level applied to the second control line CS2.

At a third time point TP3, a pulse of the high level may occur in the fifth clock lines SCCK5, SSCK5, and CRCK5. In this case, a voltage of the first Q node Qn may be boosted to be higher than the high level by the second and third capacitors C2 and C3, and a pulse of the high level may be output to the n-th scan line SCn, the n-th sensing line SSn, and the n-th carry line CRn. In this case, the third transistor T3 may be turned on in response to the pulse of the high level of the n-th carry line CRn.

On the other hand, despite the voltage boosting of the first Q node Qn, since the voltage of the high level is applied to the first node N1, a voltage difference between drain electrodes and source electrodes of the transistors T5, T2*b*, T20*a*, T10*a*, T12*a*, and T11*a* may not be relatively large. Therefore, deterioration of the transistors T5, T2*b*, T20*a*, T10*a*, T12*a*, and T11*a* may be prevented.

At a fourth time point, when a pulse of the high level occurs in the sixth clock lines SCCK6, SSCK6, and CRCK6, similarly to the operation of the n-th scan stage STn at the third time point TP3, a pulse of the high level may be output to the (n+1)-th scan line SC(n+1), the (n+1)-th sensing line SS(n+1), and the (n+1)-th carry line CR(n+1) from the (n+1) scan stage ST(n+1).

At the fourth time point TP4, a pulse of the high level (or first pulse) may occur in the first control line CS1. In this case, the fourth transistor T4 may be turned on. A voltage of the high level may be written to the other electrode of the first capacitor C1 through the turned-on third transistor T3 and the turned-on fourth transistor T4. That is, when the pulse of the high level occurs in the first control line CS1, the voltage of the high level may be written to only the other electrode of the first capacitor C1 of the n-th scan stage STn where the pulse of the high level occurs in the n-th carry line CRn and the (n+1)-th carry line CR(n+1), and the n-th scan stage STn may be selected as one of stages to operate in the sensing period which will be described later.

At a fifth time point TP5, since a signal of the low level is applied to the fifth clock lines SCCK5, SSCK5, and CRCK5, the voltage of the first Q node Qn that has been boosted higher than the high level may drop to the high level. For example, at the fifth time point TP5, the voltage of the first Q node Qn may drop to the same value as the voltage of the first Q node Qn charged to the high level at the second time point TP2.

At a sixth time point TP6, a pulse of the high level may occur in the first reset carry line CR(n+4). In this case, the first Q node Qn may be connected to the first power line VSS1 through the tenth transistors T10*a* and T10*b* and discharged to the low level.

At a seventh time point TP7, a pulse of the high level may occur in the (n+5)-th carry line CR(n+5).

At an eighth time point TP8, a pulse of the high level (or a second pulse) may occur in the first control line CS1. In this case, the fourth transistor T4 may be turned on.

However, at the eighth time point TP8, since the signal of the low level is applied to the n-th carry line CRn, the third transistor T3 may be turned off or maintain a turn-off state, the signal of the low level of the (n+1)-th carry line CR(n+1) may not be transferred to the other electrode of the first capacitor C1, and the voltage of the high level written to the other electrode of the first capacitor C1 may be maintained at the fourth time point TP4.

Meanwhile, at the eighth time point TP8, the pulse of the high level output at the seventh time point TP7 may be maintained in the (n+5)-th carry line CR(n+5). That is, a pulse of the high level may be applied to the (n+5)-th carry line CR(n+5). In addition, at the eighth time point TP8, a pulse of the high level may occur in the (n+6)-th carry line CR(n+6). In this case, a voltage of the high level may be written to the first capacitor C1 of a scan stage (for example, the (n+5)-th scan stage which is the fifth scan stage from the n-th scan stage STn) using the (n+5)-th carry line CR(n+5) and the (n+6)-th carry line CR(n+6) as the first sensing carry line and the second sensing carry line, and the stage may be selected as one of the stages to operate in the sensing period, together with the n-th scan stage STn.

Figure 6:
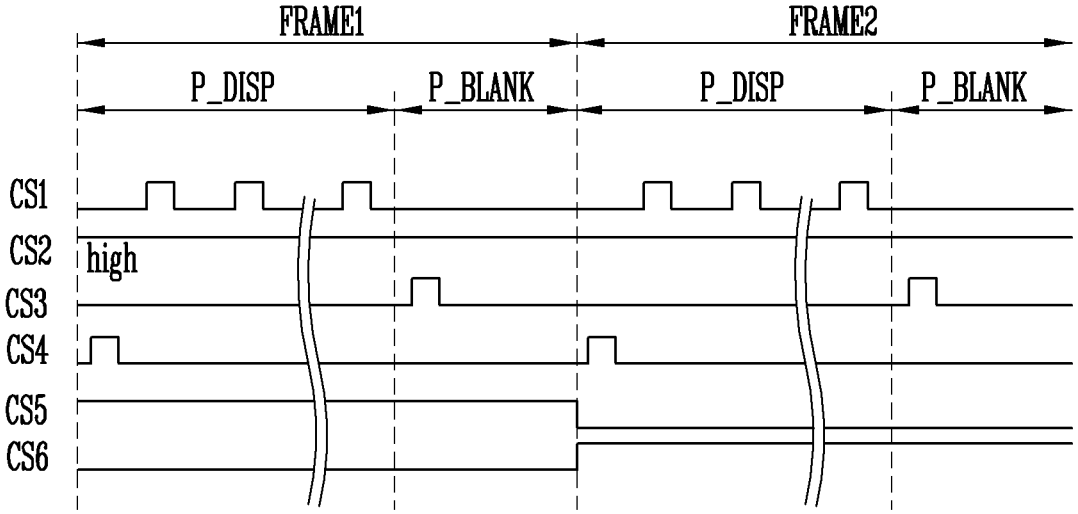
FIG. 6 is a diagram illustrating control signals applied to the scan driver of FIG. 3.

In an exemplary embodiment, a control signal of the high level may be alternately applied to the fifth control line CS5 and the sixth control line CS6 in a specific time period unit. The specific time period unit may correspond to, for example, a plurality of frame sections. FIG. 6 may be referred to in order to describe the control signal applied to the fifth control line CS5 and the sixth control line CS6.

FIG. 6 is a diagram illustrating control signals applied to the scan driver of FIG. 3.

Referring to FIG. 6, each of frame periods FRAME1 and FRAME2 (or frames) may include a display period P_DISP and a sensing period P_BLANK. In the display period P_DISP, a signal of the first control line CS1, a signal of the second control line CS2, a signal of the third control line CS3, and a signal of the fourth control line CS4 are substantially the same as the signal of the first control line CS1, the signal of the second control line CS2, the signal of the third control line CS3, and the signal of the fourth control line CS4 described with reference to FIG. 5. Therefore, duplicate descriptions will not be repeated. Meanwhile, the signal of the first control line CS1, the signal of the second control line CS2, the signal of the third control line CS3, and the signal of the fourth control line CS4 in the sensing period P_BLANK will be described later with reference to FIG. 7.

During the first frame period FRAME1, a control signal of the high level may be applied to the fifth control line CCS5 and a control signal of the low level may be applied to the sixth control line CCS6. In this case, the twenty-fifth and twenty-sixth transistors T25 and T26 may be turned on and thus the first QB node QBn may be charged to the high level. Therefore, the eleventh transistors T11*a* and T11*b* may be turned on, and thus, the first Q node Qn may be discharged to the low level, the thirteenth transistor T13 may be turned on and thus the n-th carry line CRn may be discharged to the low level, the fifteenth transistor T15 may be turned on and thus the n-th sensing line SSn may be discharged to the low level, and the seventeenth transistor T17 may be turned on and thus the n-th scan line SCn may be discharged to the low level.

During the second frame period FRAME2, a control signal of the low level may be applied to the fifth control line CCS5 and a control signal of the high level may be applied to the sixth control line CCS6. In this case, the thirty-fifth and thirty-sixth transistors T35 and T36 may be turned on and thus the second QB node QB(n+1) may be charged to the high level. Therefore, the twelfth transistors T12*a* and T12*b* may be turned on and thus the first Q node Qn may be discharged to the low level, the fourteenth transistor T14 may be turned on and thus n-th carry line CRn may be discharged to the low level, the sixteenth transistor T16 may be turned on and thus the n-th sensing line SSn may be discharged to the low level, and the eighteenth transistor T18 may be turned on and thus the n-th scan line SCn may be discharged to the low level.

Therefore, a period during which on-bias is applied to the transistors used during the first and second frame periods FRAME1 and FRAME2 may be shortened, and the deterioration of the transistors may be prevented.

According to driving of the scan driver described with reference to FIG. 5, a pulse of the high level may be applied to the scan line SCi and the sensing line SSi described with reference to FIG. 2 during the display period of one frame period. At this time, a corresponding data signal may be applied to the data line Dj, and a first reference voltage may be applied to the reception line Ri. Therefore, the storage capacitor Cst described with reference to FIG. 2 may store a voltage corresponding to a difference between the data signal and the first reference voltage while the second and third thin film transistors M2 and M3 are turned on. Thereafter, when the second and third thin film transistors M2 and M3 are turned off, an amount of a driving current flowing through the first thin film transistor M1 may be determined in correspondence with the voltage stored in the storage capacitor Cst, and the light emitting element LD may emit light at a luminance corresponding to the amount of the driving current.

As described with reference to FIGS. 4 and 5, a signal of the high level may be applied to the first control line CS1 in correspondence with a period during which a signal of the high level is applied to both of adjacent carry lines. Therefore, a voltage of the high level may be written to the first capacitor C1 (or the sixth capacitor C6) of a scan stage using the two adjacent carry lines as the first sensing carry line and the second sensing carry line in correspondence with the signal of the first control line CS1, and the scan stage may be selected as one of the stages to operate in the sensing period to output a signal in the sensing period. Alternatively, a voltage of the low level may be maintained at the first capacitor C1 (or the sixth capacitor C6) of a scan stage that does not use any one of the two adjacent carry lines as the sensing carry lines (first sensing carry line and second sensing carry line), and the scan stage may not output a signal to the scan line and the sensing line in the sensing period. Therefore, only scan stages selected as stages to operate in the sensing period may output a signal in the sensing period.

FIG. 7 is a waveform diagram illustrating a method of driving the scan driver of FIG. 3 in the sensing period.

Referring to FIGS. 4 and 7, signals applied to the third control line CS3, the fourth scan clock line SCCK4, the fourth sensing clock line SSCK4, the fifth scan clock line SCCK5, the fifth sensing clock line SSCK5, the carry clock lines CRCK1 to CRCK6, the n-th scan line SCn, the (n+5)-th scan line SC(n+5), the n-th carry line CRn, the (n+5)-th carry line CR(n+5), the n-th sensing line SSn, and the (n+5)-th sensing line SS(n+5) are shown.

At a ninth time point TP9, a pulse of the high level may occur in the third control line CS3. In this case, the sixth transistor T6 (refer to FIG. 4) may be turned on. Since the first capacitor C1 is in a state where the voltage is charged during the display period (that is, a period between the fourth time point TP4 and the fifth time point TP5 described with reference to FIG. 5), the fifth transistor T5 may be turned on. Therefore, a voltage of the high level applied to the second control line CS2 may be applied to the first Q node Qn through the fifth transistor T5 and the sixth transistor T6.

At this time, since the fifth transistor (or the forty-eighth transistor) is turned off in the scan stages other than the n-th scan stage STn, the first Q node and the second Q node of the other scan stages may maintain the low level.

As described with reference to FIG. 4, the (n+5)-th scan stage ST(n+5) may include substantially the configuration same as the (n+1)-th scan stage ST(n+1). In an exemplary embodiment, the sixth capacitor C6 of the (n+5)-th scan stage ST(n+5) may be in a state where a voltage is charged during the display period. In this case, the forty-eighth transistor T48 may be turned on. In addition, since a pulse of the high level occurs in the third control line CS3 and thus the forty-seventh transistor T47 is also turned on, the voltage of the high level applied to the second control line CS2 may also be applied to the second Q node Q(n+1) through the forty-seventh transistor T47 and the forty-eighth transistor T48.

Thereafter, at a tenth time point TP10, a signal of the high level may be applied to the fifth scan clock line SCCK5 and the fifth sensing clock line SSCK5. In this case, the voltage of the first Q node Qn may be boosted by the second and third capacitors C2 and C3 (refer to FIG. 4), and a signal of the high level may output to the n-th scan line SCn and the n-th sensing line SSn.

Therefore, the thin film transistors M2 and M3 (refer to FIG. 2) of the pixels connected to the n-th scan line SCn and the n-th sensing line SSn may be turned on. In this case, a second reference voltage may be applied to the data lines, and the sensing unit 14 (refer to FIG. 1) may measure the deterioration information or the characteristic information of the pixels according to a current value or a voltage value received through the reception lines Rj, . . . .

However, at the tenth time point TP10, a signal of the low level may be applied to the fourth scan clock line SCCK4 and the fourth sensing clock line SSCK4. Therefore, a signal of the low level may be output to the (n+5)-th scan line SC(n+5) and the (n+5)-th sensing line SS(n+5).

In addition, since nodes corresponding to the first Q node or the second in other scan stages (for example, stages connected to the fifth scan clock line SCCK5 and the fifth sensing clock line SSCK5) except for the n-th scan stage STn are the low level, despite the pulses of the high level applied to the fifth scan clock line SCCK5 and the fifth sensing clock line SSCK5, a signal of the low level may also be output to corresponding scan lines and sensing lines.

At an eleventh time point TP11, a signal of the high level may be applied to the fifth scan clock line SCCK5 and the fifth sensing clock line SSCK5. In this case, immediately previous data signals may be applied to the data lines again. Therefore, the pixels connected to the n-th scan line SCn and the n-th sensing line SSn may emit light at grayscales based on the immediately-previous data signals again.

That is, during a period between the tenth time point TP10 and the eleventh time point TP11, the pixels connected to the n-th scan line SCn and the n-th sensing line SSn may not emit light at grayscales based on the data signals. However, after the eleventh time point TP11, the pixels connected to the n-th scan line SCn and the n-th sensing line SSn emit light again at the grayscales based on the data signals, and pixels connected to other scan lines and sensing lines may continuously emit light at the grayscales based on the data signals during the sensing period. Therefore, there may be no problem for a user to recognize the frame.

Thereafter, at a twelfth time point TP12, a signal of the high level may be applied to the fourth scan clock line SCCK4 and the fourth sensing clock line SSCK4. In this case, the voltage of the second Q node Q(n+1) may be boosted by the fourth and fifth capacitors C4 and C5 (refer to FIG. 4), and a signal of the high level may output to the (n+5)-th scan line SC(n+5) and the (n+5)-th sensing line SS(n+5).

Therefore, the thin film transistors M2 and M3 (refer to FIG. 2) of the pixels connected to the (n+5)-th scan line SC(n+5) and the (n+5)-th sensing line SS(n+5) may be turned on. In this case, the second reference voltage may be applied to the data lines, and the sensing unit 14 (refer to FIG. 1) may measure the deterioration information or the characteristic information of the pixels according to a current value or a voltage value received through the reception lines Rj, . . . .

At a thirteenth time point TP13, a signal of the high level may be applied to the fourth scan clock line SCCK4 and the fourth sensing clock line SSCK4. In this case, immediately previous data signals may be applied to the data lines again. Therefore, the pixels connected to the (n+5)-th scan line SC(n+5) and the (n+5)-th sensing line SS(n+5) may emit light at the grayscales based on the immediately previous data signals again.

However, a time point when the signal of the high level is applied to the scan clock lines SCCK4 and SCCK5 and the sensing clock lines SSCK4 and SSCK5 in the sensing period is exemplary. The signal of the high level may be applied to the fourth scan clock line SCCK4 and the fourth sensing clock line SSCK4 at the tenth time point TP10, and the signal of the high level may be applied to the fifth scan clock line SCCK5 and the fifth sensing clock line SSCK5 at the twelfth time point TP12.

As described with reference to FIG. 7, the deterioration information or the characteristic information of the pixels connected to the n-th scan line SCn and the n-th sensing line SSn may be measured by applying the signal of the high level to the fifth scan clock line SCCK5 and the fifth sensing clock line SSCK5 in the period between the tenth time point TP10 and the eleventh time point TP11. In addition, the deterioration information or the characteristic information of the pixels connected to the (n+5)-th scan line SC(n+5) and the (n+5)-th sensing line SS(n+5) may be measured by applying the signal of the high level to the fourth scan clock line SCCK4 and the fourth sensing clock line SSCK4 in the period between the twelfth time point TP12 and the thirteenth time point TP13. That is, characteristics of the pixels included in different pixel rows may be sensed (or multi-sensed) during one frame period, and a total time (or sensing period) for sensing the characteristics of all pixels in the display panel may be reduced, and the characteristics of the pixels may be further compensated for in real time.

Figure 8:
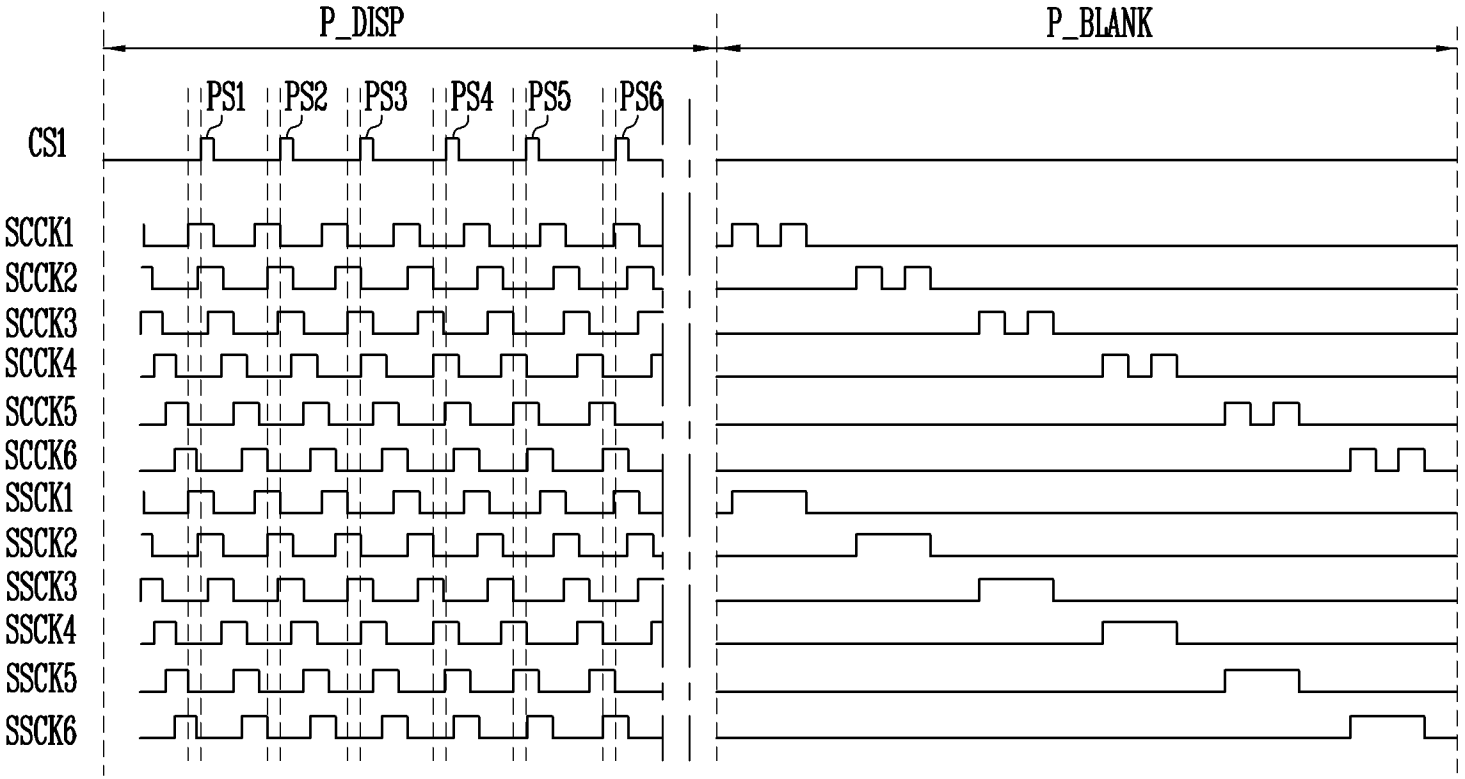
FIG. 8 is a diagram for describing a method of driving the scan driver of FIG. 3.

FIG. 8 is a diagram for describing a method of driving the scan driver of FIG. 3.

Referring to FIG. 8, signals applied to the first control line CS1, the scan clock lines SCCK1 to SCCK6, and the sensing clock lines SSCK1 to SSCK6 are shown.

In a display period P_DISP, scan clock lines SCCK1 to SCCK6 and sensing clock lines SSCK1 to SSCK6 are substantially the same as the scan clock lines SCCK1 to SCCK6 and the sensing clock lines SSCK1 to SSCK6 described with reference to FIG. 5, and thus, duplicate descriptions will not be repeated.

In the display period P_DISP, the signal of the first control line CS1 may include a plurality of pulses of the high level. For example, the signal of the first control line CS1 may include first-to-sixth pulses PS1 to PS6 having the high level.

The first pulse PS1 may overlap a period during which a signal of the high level is applied to the first scan clock line SCCK1 and the first sensing clock line SSCK1 and a signal of the high level is applied to the second scan clock line SCCK2 and the second sensing clock line SSCK2. However, this is an exemplary, and the first pulse PS1 may overlap a period during which a signal of the high level is applied to the second scan clock line SCCK2 and the second sensing clock line SSCK2 and a signal of the high level is applied to the third scan clock line SCCK3 and the third sensing clock line SSCK3.

Similarly, the second pulse PS2 may overlap a period during which a signal of the high level is applied to the second scan clock line SCCK2 and the second sensing clock line SSCK2 and a signal of the high level is applied to the second scan clock line SCCK2 and the second sensing clock line SSCK2, the third pulse PS3 may overlap a period during which a signal of the high level is applied to the third scan clock line SCCK3 and the third sensing clock line SSCK3 and a signal of the high level is applied to the fourth scan clock line SCCK4 and the fourth sensing clock line SSCK4, the fourth pulse PS4 may overlap a period during which a signal of the high level is applied to the fourth scan clock line SCCK4 and the fourth sensing clock line SSCK4 and a signal of the high level is applied to the fifth scan clock line SCCK5 and the fifth sensing clock line SSCK5, the fifth pulse PS5 may overlap a period during which a signal of the high level is applied to the fifth scan clock line SCCK5 and the fifth sensing clock line SSCK5 and a signal of the high level is applied to the sixth scan clock line SCCK6 and the sixth sensing clock line SSCK6, and the sixth pulse PS6 may overlap a period during which a signal of the high level is applied to the sixth scan clock line SCCK6 and the sixth sensing clock line SSCK6 and a signal of the high level is applied to the first scan clock line SCCK1 and the first sensing clock line SSCK1. That is, the first-to-sixth pulses PS1 to PS6 may have the high level in correspondence with two adjacent scan clock lines which are mutually different from each other (and two adjacent random sensing clock lines which are mutually different from each other). In this case, the scan stages in front of the two scan stages respectively connected to two adjacent scan clock lines which are mutually different from each other (and two adjacent sensing clock lines which are mutually different from each other) may be selected as the stages to operate in the sensing period.

Thereafter, a signal of the high level may be sequentially applied to the scan clock lines SCCK1 to SCCK6 and the sensing clock lines SSCK1 to SSCK6 in the sensing period P_BLANK. The signals respectively applied to the scan clock lines SCCK1 to SCCK6 may have substantially the same or the same waveform as the signal described with reference to FIG. 7 (that is, the signal applied to the fifth scan clock line SCCK5), and signals respectively applied to the sensing clock lines SSCK1 to SSCK6 may have substantially the same or the same waveform as the signal described with reference to FIG. 7 (that is, the signal applied to the fifth sensing clock line SSCK5). Therefore, duplicate descriptions will not be repeated.

By sequentially applying the signal of the high level is sequentially applied to the scan clock lines SCCK1 to SCCK6 and the sensing clock lines SSCK1 to SSCK6, the stages selected in the display period P_DISP may sequentially operate, and the signal of the high level may be output to the corresponding scan lines and sensing lines. Therefore, characteristics of pixels included in six pixel rows may be sensed (or multi-sensed) during the sensing period P_BLANK.

Meanwhile, although the signal applied to the first control line CS1 include the six pulses during the display period P_DISP in FIG. 8, this is exemplary and is not limited thereto. For example, the signal applied to the first control line CS1 may include two to five pulses during the display period P_DISP. As another example, when the scan driver 13 (refer to FIG. 1) includes k scan clock lines and k sensing clock lines that are mutually different from each other, the signal applied to the first control line CS1 may include k pulses during the display period P_DISP.

Figure 9:
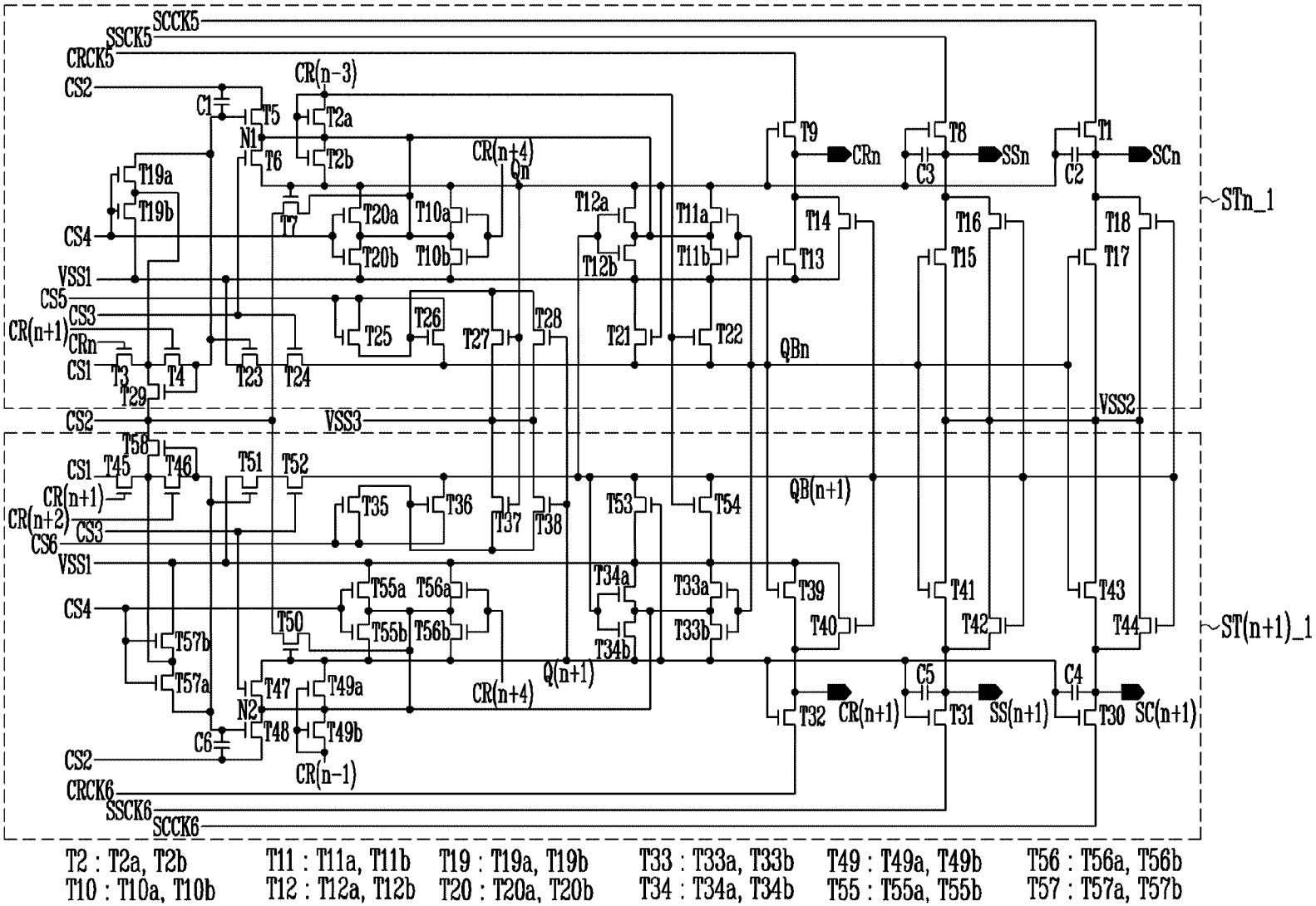
FIG. 9 is a circuit diagram illustrating another example of the m-th stage group included in the scan driver of FIG. 3.

FIG. 9 is a circuit diagram illustrating another example of the m-th stage group included in the scan driver of FIG. 3.

Referring to FIGS. 4 and 9, the m-th stage group STGm_1 of FIG. 9 is substantially the same as or similar to the m-th stage group STGm of FIG. 4 except for a connection configuration of the third transistor T3, the fourth transistor T4, the forty-fifth transistor T45, and the forty-sixth transistor T46. Therefore, duplicate descriptions will not be repeated.

The one electrode of the third transistor T3 may be connected to the first control line CS1, and the gate electrode of the fourth transistor T4 may be connected to the (n+1)-th carry line CR(n+1) (or second sensing carry line).

The one electrode of the forty-fifth transistor T45 may be connected to the first control line CS1, and the gate electrode of the forty-sixth transistor T46 may be connected to the (n+2)-th carry line CR(n+2).

Referring to FIGS. 5 and 9, a pulse of the high level may be applied to the n-th carry line CRn and the (n+1)-th carry line CR(n+1). In this case, the third transistor T3 and the fourth transistor T4 may be turned on, or may maintain a turn-on state.

In addition, at the fourth time point TP4, a pulse of the high level may occur in the first control line CS1. Therefore, a voltage of the high level may be written to the other electrode of the first capacitor C1 through the turned-on third transistor T3 and the turned-on fourth transistor T4. That is, when the pulse of the high level occurs in the first control line CS1, the voltage of the high level may be written to only the other electrode of the first capacitor C1 of the n-th scan stage STn where the pulse of the high level occurs in the n-th carry line CRn and the (n+1)-th carry line CR(n+1), and the n-th scan stage STn may be selected as one of stages to operate in the sensing period which will be described later.

Figure 10:
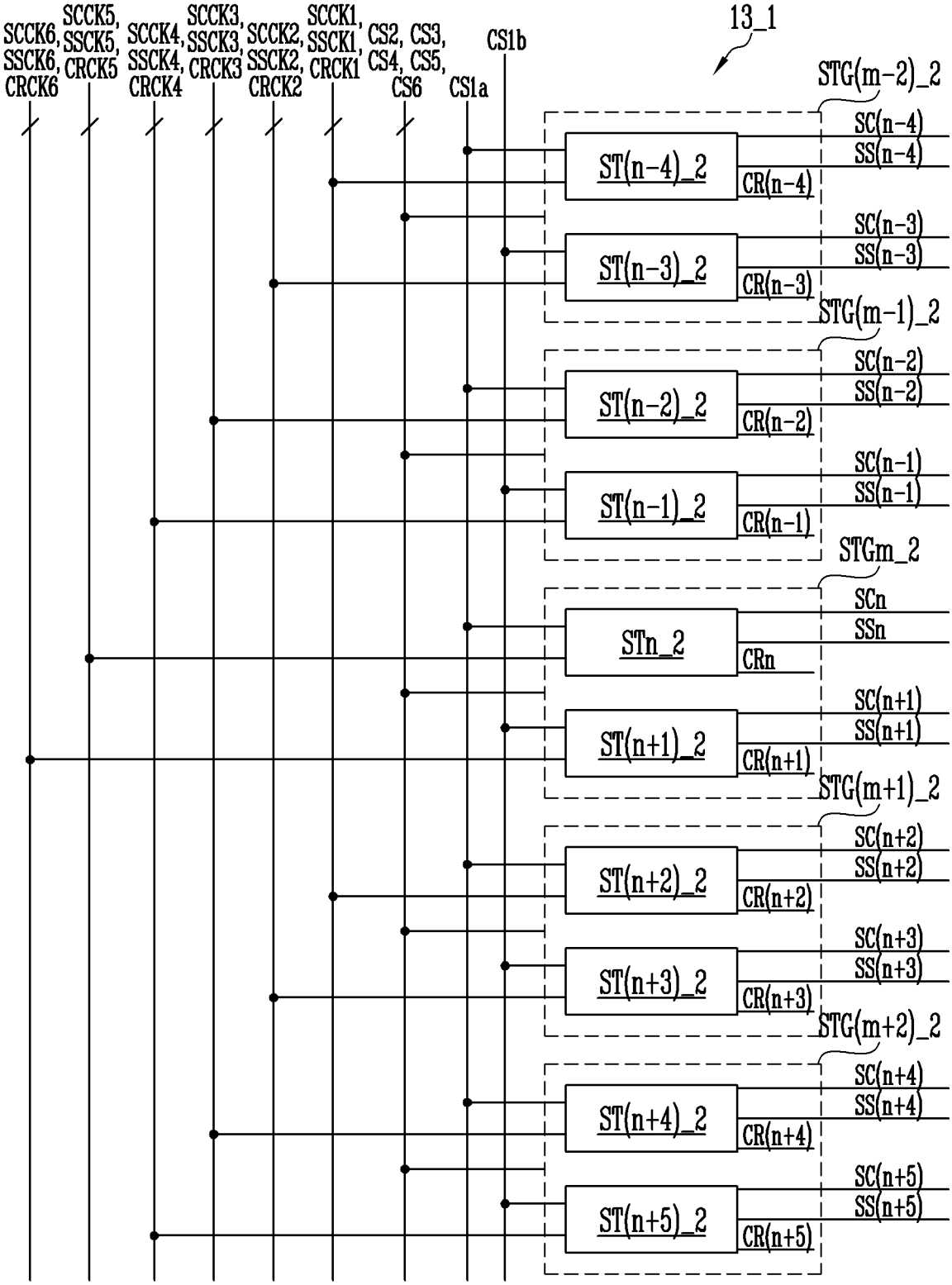
FIG. 10 is a diagram illustrating another example of the scan driver included in the display device of FIG. 1.

FIG. 10 is a diagram illustrating another example of the scan driver included in the display device of FIG. 1.

Referring to FIGS. 3 and 10, the scan driver 13_1 of FIG. 10 is different from the scan driver 13 of FIG. 3 in that the scan driver 13_1 of FIG. 10 is connected to a first sub-control line CS1*a* and a second sub-control line CS1*b* instead of the first control line CS1. Since the scan driver 13_1 of FIG. 10 is substantially the same as or similar to the scan driver 13 of FIG. 3, duplicate descriptions will not be repeated.

The scan driver 13_1 may include a plurality of stage groups . . . STG(m−2)_2, STG(m−1)_2, STGm_2, STG(m+1)_2, STG(m+2)_2, and . . . .

Each of the stage groups STG(m−2)_2 to STG(m+2)_2 may include a first scan stage and a second scan stage. The first scan stage may be an odd-numbered scan stage, and the second scan stage may be an even-numbered scan stage. For example, the (m−2)-th stage group STG(m−2)_2 may include an (n−4)-th (where n is an integer equal to or greater than 4) scan stage ST(n−4)_2 and an (n−3)-th scan stage ST(n−3)_2), the (m−1)-th stage group STG(m−1)_2 may include an (n−2)-th scan stage ST(n−2)_2 and an (n−1)-th-scan stage ST(n−1)_2, the m-th stage group STGm_2 may include an n-th scan stage STn_2 and an (n+1)-th-scan stage ST(n+1)_2, the (m+1)-th stage group STG(m+1)_2 may include an (n+2)-th scan stage ST(n+2)_2 and an (n+3)-th-scan stage ST(n+3)_2, and the (m+2)-th stage group STG(m+2)_2 may include an (n+4)-th scan stage ST(n+4)_2 and an (n+5)-th-scan stage ST(n+5)_2. Each of the (n−4)-th scan stage ST(n−4)_2, the (n−2)-th scan stage ST(n−2)_2, the n-th scan stage STn_2, the (n+2)-th scan stage ST(n+2)_2, and the (n+4)-th scan stage ST(n+4)_2 may be the odd-numbered scan stage, and each of the (n−3)-th-scan stage ST(n−3)_2, the (n−1)-th-scan stage ST(n−1)_2, the (n+1)-th-scan stage ST(n+1)_2, the (n+3)-th-scan stage ST(n+3)_2, and the (n+5)-th-scan stage ST(n+5)_2 may be the even-numbered scan stage.

Each of the scan stages ST(n−4)_2 to ST(n+5)_2 may be connected to the first sub-control line CS1*a* or the second sub-control line CS1*b*. Each of first scan stages (or odd-numbered scan stages) included in each of the stage groups STG(m−2)_2 to STG(m+2)_2 may be connected to the first sub-control line CS1*a*. A common control signal may be applied to the first scan stages (or odd-numbered scan stages) through the first sub-control line CS1*a*.

Similarly, each of second scan stages (or even-numbered scan stages) included in each of the stage groups STG(m−2)_2 to STG(m+2)_2 may be connected to the second sub-control line CS1*b*. A common control signal may be applied to the second scan stages (or even-numbered scan stages) through the second sub-control line CS1*b*.

However, this is exemplary, and a connection relationship between the stage groups STG(m−2)_2 to STG(m+2)_2 and the first and second sub-control lines CS1*a* and CS1*b* is not limited thereto. For example, each of the first scan stages (or odd-numbered scan stages) included in each of the stage groups STG(m−2)_2 to STG(m+2)_2 may be connected to the second sub-control line CS1*b*, and each of the second scan stages (or even-numbered scan stages) included in each of the stage groups STG(m−2)_2 to STG(m+2)_2 may be connected to the first sub-control line CS1*a*.

Figure 11:
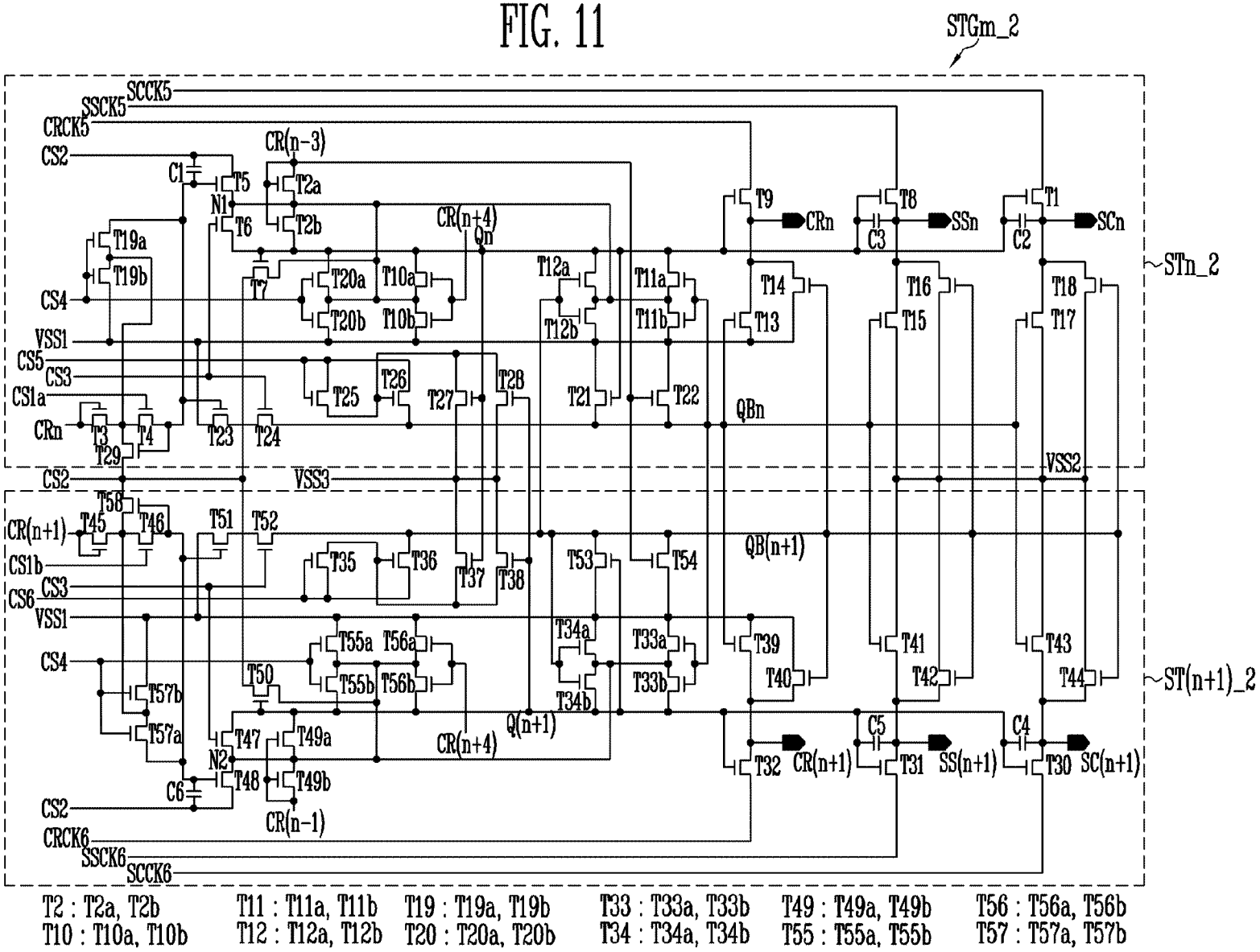
FIG. 11 is a circuit diagram illustrating an example of an m-th stage group included in the scan driver of FIG. 10.

FIG. 11 is a circuit diagram illustrating an example of the m-th stage group included in the scan driver of FIG. 10.

Referring to FIGS. 4 and 11, the m-th stage group STGm_2 of FIG. 11 is substantially the same as or similar to the m-th stage group STGm of FIG. 4 except for a connection configuration of the third transistor T3, the fourth transistor T4, the forty-fifth transistor T45, and the forty-sixth transistor T46. Therefore, duplicate descriptions will not be repeated.

The gate electrode and one electrode of the third transistor T3 may be connected to the n-th carry line CRn (or first sensing carry line), and the gate electrode of the fourth transistor T4 may be the first sub-control line CS1*a*.

The gate electrode and the one electrode of the forty-fifth transistor T45 may be connected to the (n+1)-th carry line CR(n+1), and the gate electrode of the forty-sixth transistor T46 may be connected to the second sub-control line CS1*b*.

Figure 12:
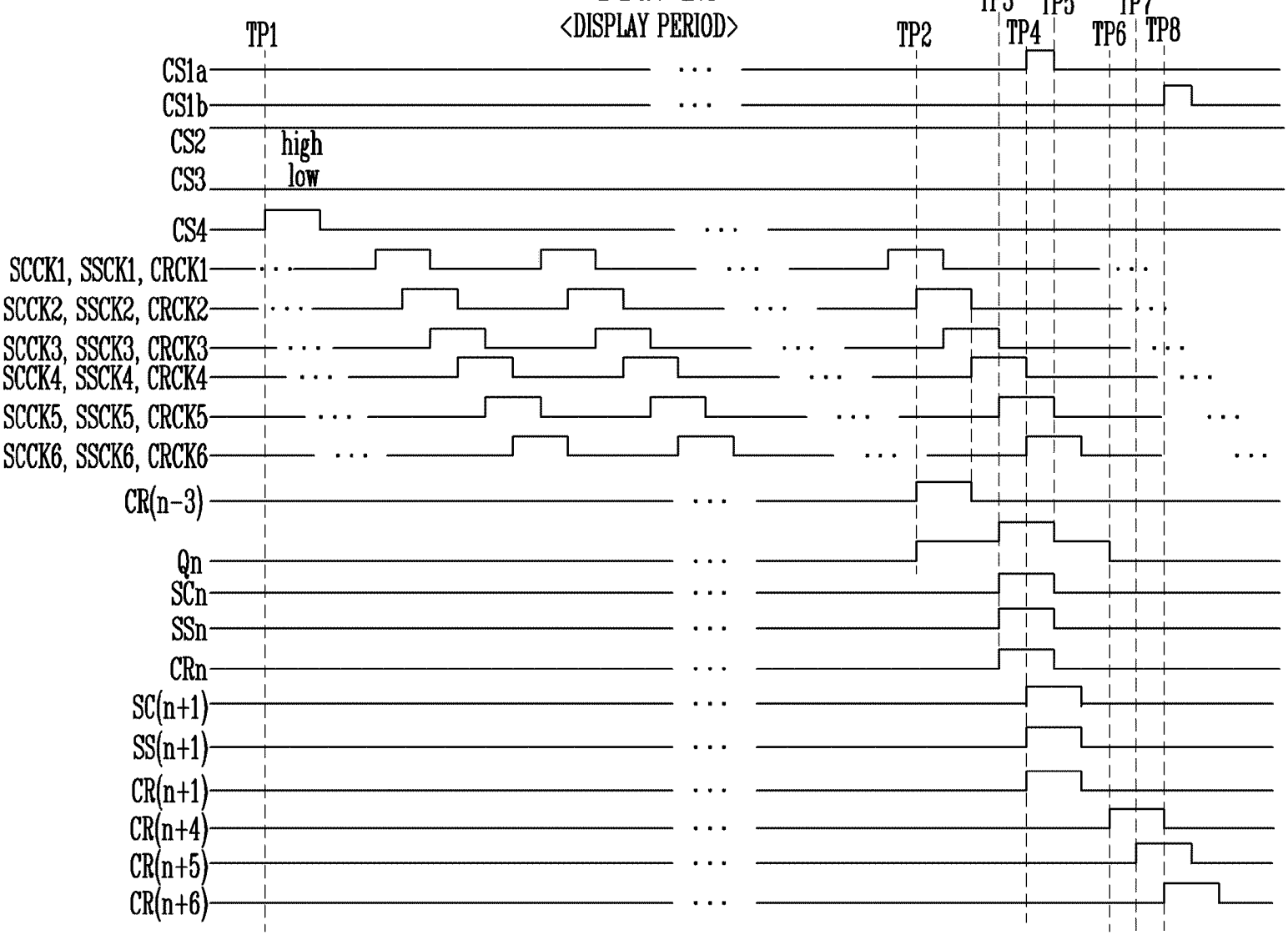
FIG. 12 is a waveform diagram illustrating a method of driving the scan driver of FIG. 10 in the display period.

FIG. 12 is a waveform diagram illustrating a method of driving the scan driver of FIG. 10 in the display period.

In FIGS. 10 to 12, since the method of driving the scan driver described with reference to FIGS. 10 to 12 is substantially the same or similar to the method of driving the scan driver described with reference to FIGS. 3 to 5, duplicate descriptions will not be repeated.

Referring to FIGS. 10 to 12, signals applied to the first sub-control line CS1*a*, the second sub-control line CS1*b*, the second control line CS2, the third control line CS3, the fourth control line CS4, the scan clock lines SCCK1 to SCCK6, the sensing clock lines SSCK1 to SSCK6, the carry clock lines CRCK1 to CRCK6, the (n−3)-th carry line CR(n−3) (or first scan carry line), the n-th scan line SCn (or first scan line), the (n+1)-th scan line SC(n+1) (or second scan line), the n-th sensing line SSn (or first sensing line), the (n+1)-th sensing line SS(n+1) (or second sensing line), the n-th carry line CRn (first carry line, or first sensing carry line), and the (n+1)-th carry line CR(n+1) (second carry line, or second sensing carry line) are shown.

At the third time point TP3, a pulse of the high level may be output to the n-th carry line CRn. In this case, the third transistor T3 may be turned on in response to the pulse of the high level of the n-th carry line CRn.

In addition, at the fourth time point TP4, a pulse of the high level may occur in the first sub-control line CS1*a*. In this case, the fourth transistor T4 may be turned on. A voltage of the high level may be written to the other electrode of the first capacitor C1 through the turned-on third transistor T3 and the turned-on fourth transistor T4. That is, when the pulse of the high level occurs in the first sub-control line CS1*a*, the voltage of the high level may be written to only the other electrode of the first capacitor C1 of the n-th scan stage STn where the pulse of the high level occurs in the n-th carry line CRn, and the n-th scan stage STn may be selected as one of the stages to operate in the sensing period.

Meanwhile, at the fourth time point TP4, a pulse of the high level may be applied to the (n+1)-th carry line CR(n+1). In this case, the forty-fifth transistor T45 may be turned on.

However, at the fourth time point TP4, since a pulse of the low level is applied to the second sub-control line CS1*b*, the forty-sixth transistor T46 may be turned off or maintain a turn-off state. Since the forty-sixth transistor T46 is turned off, the voltage of the low level of the one electrode of the sixth capacitor C6 may be maintained. Therefore, the voltage of the low level is maintained at the one electrode of the sixth capacitor C6 of the (n+1)-th scan stage ST(n+1) where the pulse of the high level occurs in the (n+1)-th carry line CR(n+1), and the (n+1)-th scan stage ST(n+1) may not be selected as a stage to operate in the sensing period.

At the eighth time point TP8, a pulse of the high level may occur in the second sub-control line CS1*b*.

However, at the eighth time point TP8, since the signal of the low level is applied to the n-th carry line CRn, the third transistor T3 may be turned off or maintain a turn-off state, and since the signal of the low level is applied to the first sub-control line CS1*a*, the fourth transistor T4 may be turned off or maintain a turn-off state. Therefore, the signal of the low level of the n-th carry line CRn may not be transferred to the other electrode of the first capacitor C1, and the voltage of the high level written to the other electrode of the first capacitor C1 may be maintained at the fourth time point TP4.

Meanwhile, at the eighth time point TP8, the pulse of the high level output at the seventh time point TP7 may be maintained in the (n+5)-th carry line CR(n+5). That is, a pulse of the high level may be applied to the (n+5)-th carry line CR(n+5). In this case, a voltage of the high level may be written to the first capacitor C1 of a scan stage (for example, the (n+5)-th scan stage which is the fifth scan stage from the n-th scan stage STn) using the (n+5)-th carry line CR(n+5) as the first sensing carry line, and the stage may be selected as one of the stages to operate in the sensing period, together with the n-th scan stage STn.

As described with reference to FIGS. 11 and 12, the first sub-control line CS1*a* and the second sub-control line CS1*b* are alternately connected to the scan stages. Therefore, even though the signal of the high level is applied to the first sub-control line CS1*a*, scan stages connected to the second sub-control line CS1*b* adjacent to the scan stage selected as one of the stages connected to the first sub-control line CS1 and to operate in the sensing period may not output a signal to the scan line and the sensing line in the sensing period, since the signal of the low level is applied to the second sub-control line CS1*b* and the forty-sixth transistor T46 (or the fourth transistor T4) is turned off or maintain a turn-off state, although the signal of the high level is applied to the carry line and thus the forty-fifth transistor T45 (or the third transistor T3) is turned on. Therefore, only scan stages selected as stages to operate in the sensing period may output a signal in the sensing period.

Figure 13:
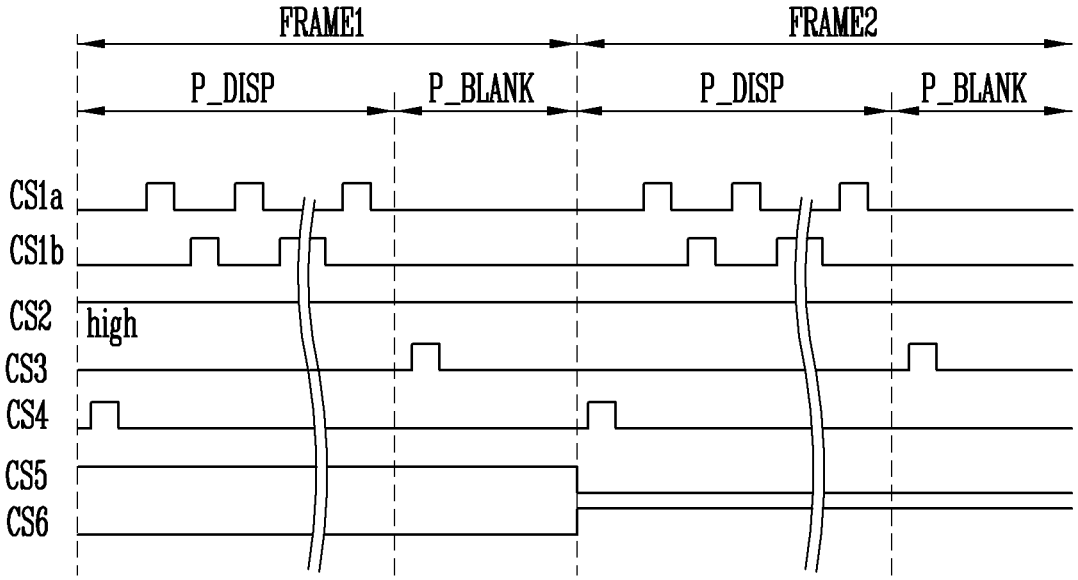
FIG. 13 is a diagram illustrating control signals applied to the scan driver of FIG. 10.

FIG. 13 is a diagram illustrating control signals applied to the scan driver of FIG. 10.

Referring to FIG. 13, except for the signal of the first sub-control line CS1*a* and the signal of the second sub-control line CS1*b*, the waveforms of the control signals CS2, CS3, CS4, CS5, and CS6 are substantially the same as the waveforms of the control signals CS2, CS3, CS4, CS5, and CS6 shown in FIG. 6, respectively. Therefore, duplicate descriptions will not be repeated.

Except for the signal of the first sub-control line CS1*a* and the signal of the second sub-control line CS1*b* in the display period P_DISP, the waveforms of the control signals CS2, CS3, CS4, CS5, and CS6 are substantially the same as the waveforms of the control signals CS2, CS3, CS4, CS5, and CS6 shown in FIG. 6, respectively. Therefore, duplicate descriptions will not be repeated.

In addition, in the display period P_DISP, the signal of the first sub-control line CS1*a* and the signal of the second sub-control line CS1*b* are substantially the same as the signal of the first sub-control line CS1*a* and the signal of the second sub-control line CS1*b* described with reference to FIG. 12, respectively. Therefore, duplicate descriptions will not be repeated.

In the display period P_DISP, a signal of the high level may be applied to the first sub-control line CS1*a* and the second sub-control line CS1*b* at different time points. Therefore, as described with reference to FIGS. 11 and 12, even though a signal of the high level is applied to the first sub-control line CS1*a*, the scan stages connected to the second sub-control line CS1*b* adjacent to the scan stage selected as one of the stages connected to the first sub-control line CS1 and to operate in the sensing period may not output a signal to the scan line and the sensing line in the sensing period.

The number of pulses of the high level occurring in the first sub-control line CS1*a* in the display period D_DISP included in one frame period (for example, FRAME1) may be the same as the number of pulses of the high level occurring in the second sub-control line CS1*b* in the display period D_DISP included in the frame period. However, this is exemplary and the number of each of pulses may be different. For example, when characteristics of pixels included in three pixel rows are sensed during one frame period, the number of the pulses of the high level occurring in the first sub-control line CS1*a* in the display period D_DISP included in one frame period may be three, and there is no pulse of the high level occurring in the second sub-control line CS1*b* in the display period D_DISP included in the frame period. Alternatively, when the characteristics of the pixels included in the three pixel rows are sensed during one frame period, the number of the pulses of the high level occurring in the first sub-control line CS1*a* in the display period D_DISP included in one frame period may be two, and the number of the pulses of the high level occurring in the second sub-control line CS1*b* in the display period D_DISP included in the frame period may be one.

Meanwhile, in the sensing period P_BLANK, the signal of the low level is applied to the signal of the first control line CS1 (refer to FIG. 6), the signal of the first sub-control line CS1*a*, and the signal of the second sub-control line CS1*b*. In addition, in the sensing period P_BLANK, the signal of the second control line CS2, the signal of the third control line CS3, the signal of the fourth control line CS4, the signal of the fifth control line CS5, and the signal of the sixth control line CS6 are substantially the same as the signal of the second control line CS2, the signal of the third control line CS3, the signal of the fourth control line CS4, the signal of the fifth control line CS5, and the signal of the sixth control line CS6 described with reference to FIGS. 6 and 7. Therefore, an operation of the scan driver 13_1 (refer to FIG. 10) in the sensing period of FIG. 13 may be substantially the same as the operation of the scan driver 13 (refer to FIG. 3) in the sensing period described with reference to FIG. 7. Thus, duplicate description related to the operation of the scan driver 13_1 (refer to FIG. 10) in the sensing period will not be repeated.

Figure 14:
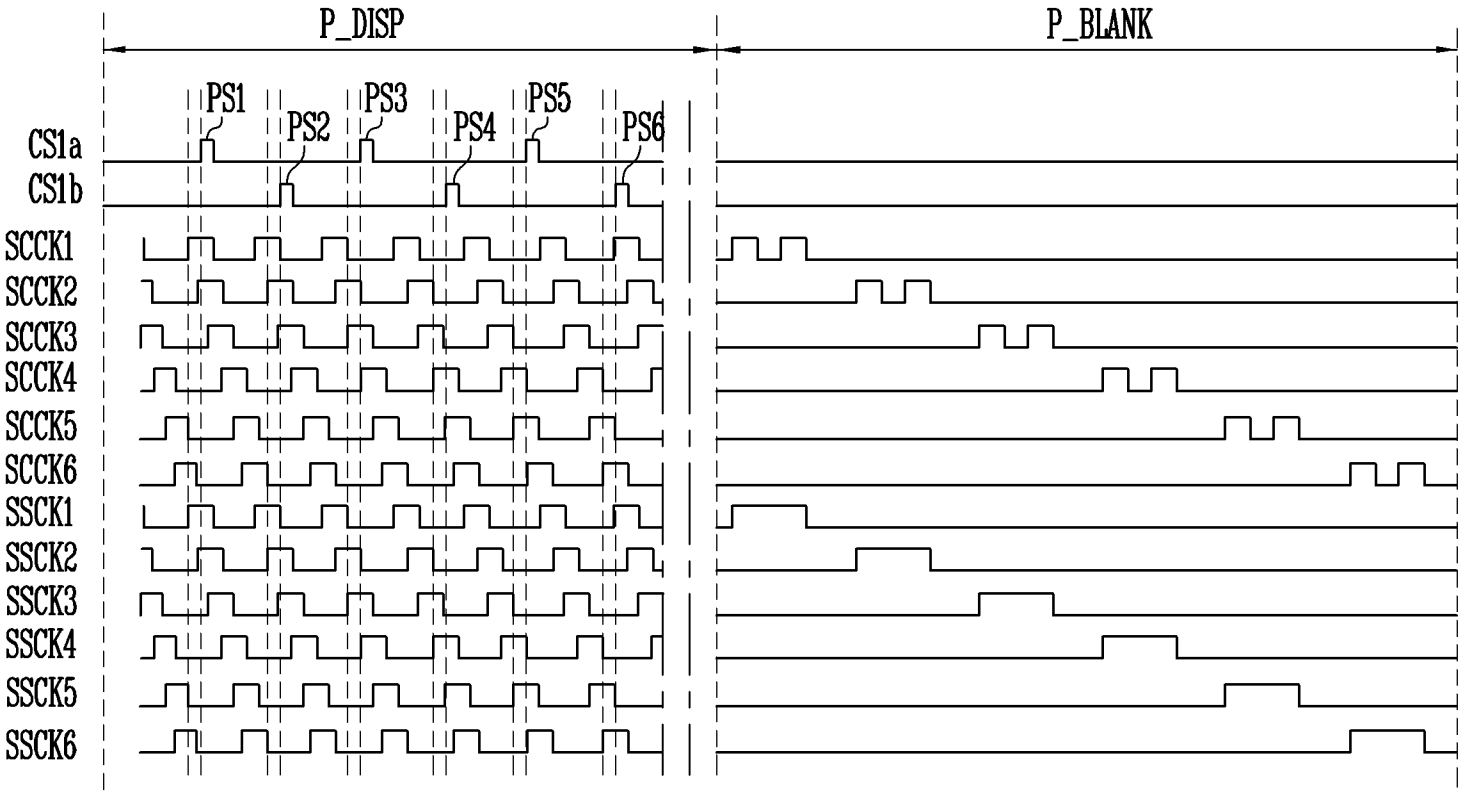
FIG. 14 is a diagram for describing a method of driving the scan driver of FIG. 10.

FIG. 14 is a diagram for describing a method of driving the scan driver of FIG. 10.

Referring to FIG. 14, signals applied to the first sub-control line CS1*a*, the second sub-control line CS1*b*, the scan clock lines SCCK1 to SCCK6, and the sensing clock lines SSCK1 to SSCK6 are shown.

In the display period P_DISP, the scan clock lines SCCK1 to SCCK6 and the sensing clock lines SSCK1 to SSCK6 are substantially the same as the scan clock lines SCCK1 to SCCK6 and the sensing clock lines described with reference to FIGS. 5 and 12, respectively. Therefore, duplicate descriptions will not be repeated.

In the display period P_DISP, the signal of the first sub-control line CS1*a* may include a plurality of pulses of the high level. Similarly, the signal of the second sub-control line CS1*b* may include a plurality of pulses of the high level. In an exemplary embodiment, a control signal of the high level may be alternately applied to the first sub-control line CS1*a* and the second sub-control line CS1*b*. For example, the signal of the first sub-control line CS1*a* may include a first pulse PS1, a third pulse PS3, and a fifth pulse PS5 having the high level. In addition, the signal of the second sub-control line CS1*b* may include a second pulse PS2, a fourth pulse PS4, and a sixth pulse PS6 having the high level. However, this is exemplary and the signal of the first sub-control line CS1*a* may include a second pulse PS2, a fourth pulse PS4, and a sixth pulse PS6 having the high level, and the signal of the second sub-control line CS1*b* may include a first pulse PS1, a third pulse PS3, and a fifth pulse PS5 having the high level.

Referring to FIGS. 8 and 14, an operation of the scan driver 13_1 (refer to FIG. 10) of FIG. 14 may be substantially the same as the operation of the scan driver 13 (refer to FIG. 3) described with reference to FIG. 8 except that each of the signal of the first sub-control line CS1*a* and the signal of the second sub-control line CS1*b* includes a plurality of pulses of the high level. Therefore, duplicate descriptions related to the operation of the scan driver 13_1 (refer to FIG. 10) will not be repeated.

Figure 15:
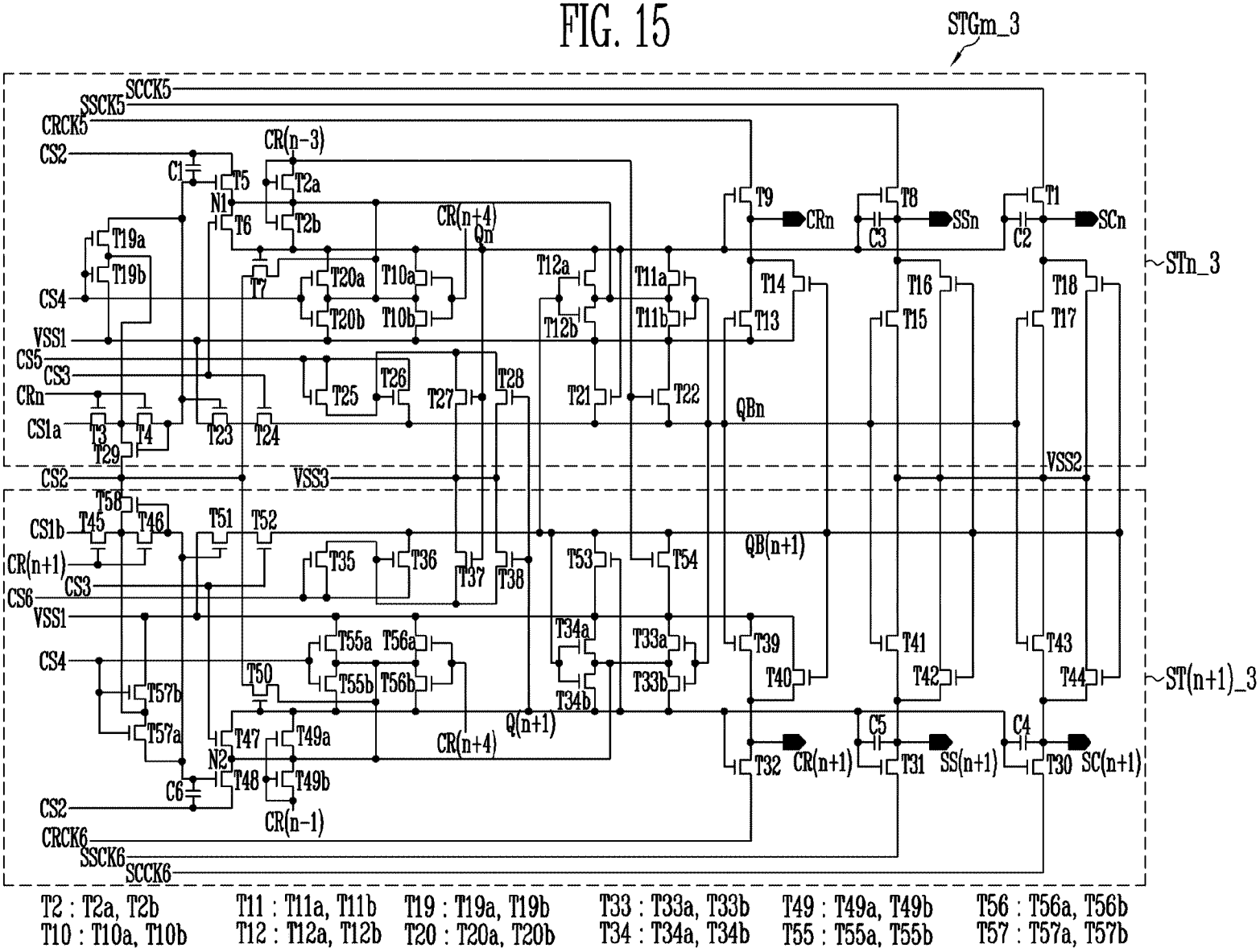
FIG. 15 is a circuit diagram illustrating another example of the m-th stage group included in the scan driver of FIG. 10.

FIG. 15 is a circuit diagram illustrating another example of the m-th stage group included in the scan driver of FIG. 10.

Referring to FIGS. 11 and 15, the m-th stage group STGm_3 of FIG. 15 is substantially the same as or similar to the m-th stage group STGm_2 of FIG. 11 except for a connection configuration of the third transistor T3, the fourth transistor T4, the forty-fifth transistor T45, and the forty-sixth transistor T46. Therefore, duplicate descriptions will not be repeated.

The one electrode of the third transistor T3 may be connected to the first sub-control line CS1*a*, and the gate electrode of the fourth transistor T4 may be connected to the n-th carry line CRn (or first sensing carry line).

The one electrode of the forty-fifth transistor T45 may be connected to the second sub-control line CS1*b*, and the gate electrode of the forty-sixth transistor T46 may be connected to the (n+1)-th carry line CR(n+1).

Referring to FIGS. 12 and 15, at the third time point TP3, a pulse of the high level may be applied to the n-th carry line CRn. In this case, the third transistor T3 and the fourth transistor T4 may be turned on.

In addition, at the fourth time point TP4, a pulse of the high level may occur in the first sub-control line CS1*a*. A voltage of the high level may be written to the other electrode of the first capacitor C1 through the turned-on third transistor T3 and the turned-on fourth transistor T4. That is, when the pulse of the high level occurs in the first sub-control line CS1*a*, the voltage of the high level may be written to only the other electrode of the first capacitor C1 of the n-th scan stage STn where the pulse of the high level occurs in the n-th carry line CRn, and the n-th scan stage STn may be selected as one of stages to operate in the sensing period.

Meanwhile, at the fourth time point TP4, a pulse of the high level may be applied to the (n+1)-th carry line CR(n+1). In this case, the forty-fifth transistor T45 and the forty-sixth transistor T46 may be turned on.

However, at the fourth time point TP4, since a pulse of the low level is applied to the second sub-control line CS1*b*, the voltage of the low level of the one electrode of the sixth capacitor C6 is written through the turned-on forty-fifth transistor T45 and the turned-on forty-sixth transistor T46, and the (n+1)-th scan stage ST(n+1) may not be selected as a stage to operate in the sensing period.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A scan driver comprising:

a plurality of scan stages including an n-th scan stage and an (n+1)-th scan stage, wherein:

odd-numbered scan stages among the plurality of scan stages are connected to a first sub-control line, and even-numbered scan stages among the plurality of scan stages are connected to a second sub-control line; and the n-th scan stage comprises:

a first transistor having a gate electrode connected to a first Q node, one electrode connected to a first scan clock line, and another electrode connected to a first scan line;

a second transistor having a gate electrode and one electrode connected to a first scan carry line, and another electrode connected to the first Q node;

a fourth transistor having a gate electrode connected to a first control line, and one electrode connected to a first sensing carry line;

a fifth transistor having a gate electrode connected to another electrode of the fourth transistor and one electrode connected to a second control line;

a first capacitor having one electrode connected to the one electrode of the fifth transistor, and another electrode connected to the gate electrode of the fifth transistor; and an eleventh transistor having a gate electrode connected to a first QB node, one electrode connected to the first Q node, and another electrode connected to a first power line.

2. The scan driver according to claim 1, wherein the n-th scan stage further comprises:

an eighth transistor having a gate electrode connected to the first Q node, one electrode connected to a first sensing clock line, and another electrode connected to a first sensing line; and a ninth transistor having a gate electrode connected to the first Q node, one electrode connected to a first carry clock line, and another electrode connected to a first carry line.

3. The scan driver according to claim 2, wherein the n-th scan stage further comprises:

a thirteenth transistor having a gate electrode connected to the first QB node, one electrode connected to the first carry line, and another electrode connected to the first power line;

a fifteenth transistor having a gate electrode connected to the first QB node, one electrode connected to the first sensing line, and another electrode connected to a second power line; and a seventeenth transistor having a gate electrode connected to the first QB node, one electrode connected to the first scan line, and another electrode connected to the second power line.

4. The scan driver according to claim 3, wherein the (n+1)-th scan stage comprises:

a thirtieth transistor having a gate electrode connected to a second Q node, one electrode connected to a second scan clock line, and another electrode connected to a second scan line;

a forty-ninth transistor having a gate electrode and one electrode connected to a second scan carry line, and another electrode connected to the second Q node;

a forty-sixth transistor having a gate electrode connected to the first control line and one electrode connected to a second sensing carry line;

a forty-eighth transistor having a gate electrode connected to another electrode of the forty-sixth transistor and one electrode connected to the second control line;

a sixth capacitor having one electrode connected to the one electrode of the forty-eighth transistor and another electrode connected to the gate electrode of the forty-eighth transistor; and a thirty-third transistor having a gate electrode connected to the first QB node, one electrode connected to the first power line, and another electrode connected to the second Q node.

5. The scan driver according to claim 4, wherein the (n+1)-th scan stage further comprises:

a thirty-first transistor having a gate electrode connected to the second Q node, one electrode connected to a second sensing clock line, and another electrode connected to a second sensing line; and a thirty-second transistor having a gate electrode connected to the second Q node, one electrode connected to a second carry clock line, and another electrode connected to a second carry line.

6. The scan driver according to claim 5, wherein the (n+1)-th scan stage further comprises:

a thirty-ninth transistor having a gate electrode connected to the first QB node, one electrode connected to the second carry line, and another electrode connected to a first power supply line;

a forty-first transistor having a gate electrode connected to the first QB node, one electrode connected to the second sensing line, and another electrode connected to the second power line; and a forty-third transistor having a gate electrode connected to the first QB node, one electrode connected to a second scan line, and another electrode connected to the second power line.

7. The scan driver according to claim 6, wherein:

a first control signal provided through the first control line includes a plurality of pulses during one frame; and a first sensing carry signal is written to the first capacitor while both of a pulse of the first sensing carry signal provided through the first sensing carry line and a pulse of a second sensing carry signal provided through the second sensing carry line overlap one of the pulses of the first control signal.

8. The scan driver according to claim 7, wherein, when the first sensing carry signal is applied to the first sensing carry line, a high-level voltage is applied to the other electrode of the first capacitor, and a low-level voltage is maintained at the other electrode of the sixth capacitor.

9. The scan driver according to claim 8, wherein, after the first sensing carry signal is applied to the first sensing carry line, the fifth transistor is turned on to apply the high-level voltage to the first Q node, and the forty-eighth transistor is in a turn-off state to maintain the low-level voltage at the second Q node.

10. A scan driver comprising:

a plurality of scan stages, wherein a first scan stage among the plurality of scan stages comprises:

a first transistor having a gate electrode connected to a first Q node, one electrode connected to a first scan clock line, and another electrode connected to a first scan line;

a second transistor having a gate electrode and one electrode connected to a first scan carry line, and another electrode connected to the first Q node;

a fourth transistor having a gate electrode connected to a first control line and one electrode connected to a first sensing carry line;

a fifth transistor having a gate electrode connected to another electrode of the fourth transistor and one electrode connected to a second control line;

a first capacitor having one electrode connected to the one electrode of the fifth transistor and another electrode connected to the gate electrode of the fifth transistor; and an eleventh transistor having a gate electrode connected to a first QB node, one electrode connected to the first Q node, and another electrode connected to a first power line.

* * * * *